US008074427B2

(12) United States Patent
Shiraishi et al.

(10) Patent No.: US 8,074,427 B2
(45) Date of Patent: Dec. 13, 2011

(54) PRODUCTION METHOD FOR CONTAINER PACKING FILLER AND TUBULAR NET ROLLING APPARATUS

(75) Inventors: Yasuyuki Shiraishi, Ibaraki (JP); Kenji Ohnishi, Ibaraki (JP); Tomoyuki Fujita, Ibaraki (JP); Masato Tsuji, Ibaraki (JP); Shinji Hiramoto, Nishinomiya (JP)

(73) Assignees: Taisei Kako Co., Ltd. (JP); Shionogi & Co. (JP)

( * ) Notice: Subject to any disclaimer, the term of this patent is extended or adjusted under 35 U.S.C. 154(b) by 90 days.

(21) Appl. No.: 12/225,512

(22) PCT Filed: Mar. 29, 2007

(86) PCT No.: PCT/JP2007/056914

§ 371 (c)(1),
(2), (4) Date: Apr. 10, 2009

(87) PCT Pub. No.: WO2007/116807

PCT Pub. Date: Oct. 18, 2007

(65) Prior Publication Data

US 2009/0217627 A1 Sep. 3, 2009

(30) Foreign Application Priority Data

Mar. 30, 2006 (JP) ..... 2006-096142

(51) Int. Cl.
*B65B 63/04* (2006.01)

(52) U.S. Cl. ..... 53/430; 53/436; 53/118

(58) Field of Classification Search ..... 53/430, 53/436, 438, 439, 114, 116, 118, 530
See application file for complete search history.

(56) References Cited

U.S. PATENT DOCUMENTS

| | | | | |
|---|---|---|---|---|
| 4,109,443 | A * | 8/1978 | Findlay | 53/118 |
| 6,098,378 | A * | 8/2000 | Wyatt | 53/430 |
| 6,467,239 | B2 * | 10/2002 | Mossbeck et al. | 53/430 |
| 6,810,643 | B1 * | 11/2004 | Gecic et al. | 53/430 |
| 6,983,578 | B1 * | 1/2006 | Suda et al. | 53/475 |
| 7,815,049 | B2 * | 10/2010 | Hiramoto et al. | 206/521 |

FOREIGN PATENT DOCUMENTS

| | | |
|---|---|---|
| JP | 2003-40335 | 2/2003 |
| JP | 2003-276754 | 10/2003 |

* cited by examiner

*Primary Examiner* — Sameh H. Tawfik
(74) *Attorney, Agent, or Firm* — Wood, Phillips, Katz, Clark & Mortimer

(57) ABSTRACT

A method and an apparatus for producing a container packing filler are provided, which ensure that a net can be correctly and speedily rolled up into a bulk or ball shape. A stretchable tubular net (N) is fitted around a columnar support member (6). Then, a distal portion of the net is forcibly folded radially outward or inward by a plurality of roller belts (30) disposed circumferentially of the net (N), while the roller belts (30) are moved toward a net proximal side axially of the net (N), whereby the net (N) is rolled up radially outward or inward with the distal portion thereof being forcibly folded by circular rotation and axial movement of the roller belts (30) to form an annular roll portion (C).

9 Claims, 25 Drawing Sheets

PRODUCTION METHOD FOR CONTAINER PACKING FILLER AND TUBULAR NET ROLLING APPARATUS

TECHNICAL FIELD

The present invention relates to a production method for a container packing filler and a tubular net rolling apparatus advantageous for use in the production method.

BACKGROUND ART

A novel form of a packing filler to be filled in an upper space of a solid drug container and a production apparatus for the packing filler have been developed by the inventors of the present invention, and disclosed in Patent Documents 1 and 2.

Patent Document 1: JP-A-2003-40335

Patent Document 2: JP-A-2003-276754

In the production apparatus, a tubular net having one closed end is fitted around a columnar support member, and rolled up radially outward from an open end thereof into a bulk or ball shape.

DISCLOSURE OF THE INVENTION

Problem to be Solved by the Invention

When the tubular net is actually rolled up by means of a prototype apparatus of the aforementioned type, however, an unrolled portion of the net ranging from the closed end to a bulk-shaped or ball-shaped roll portion has a length of about 30 to about 50 mm and, therefore, it is necessary to manually roll up the unrolled portion of the net and properly shape the resulting product after the rolling of the net by means of the apparatus.

Where a rolling member having a curved portion for guiding a distal portion of the net for the rolling is provided around the support member, the open end of the net is liable to be caught by the curved portion when the net is rolled up toward an axially proximal side with the distal portion thereof being expanded radially outward of the support member. As a result, the apparatus often fails to smoothly and properly roll up the net. In this case, the tubular net is merely gathered up like a loose sock, but is not formed into the bulk or ball shape.

It is therefore an object of the present invention to provide a container packing filler production method and a tubular net rolling apparatus which ensure that the net can be properly and speedily rolled up spherically.

Means for Solving the Problem

To achieve the aforementioned object, the present invention has the following technical aspects.

According to one aspect of the present invention, there is provided a container packing filler production method, which includes a first step of fitting a stretchable tubular net around a columnar support member, and a second step of forcibly folding a distal portion of the net radially outward or inward by a plurality of circular rotation members disposed circumferentially of the net while moving the circular rotation members toward a net proximal side axially relative to the support member, whereby the net is rolled up radially outward or inward with the distal portion thereof being folded by circular rotation and axial movement of the circular rotation members to form an annular roll portion. Thus, the distal portion of the net is forcibly folded radially outward or inward by the circular rotation of the circular rotation members, so that a rolling failure can be significantly suppressed. Further, the rolling density, the diameter and the height of the annular roll portion can be controlled by controlling the circular rotation speed of the circular rotation members to be kept in contact with the distal portion of the net and the axial movement speed of the circular rotation members. Therefore, the inventive method can accommodate a variety of net materials.

The inventive method may further include a third step of tightening the annular roll portion by drawing a portion of the net projecting from the annular roll portion to the proximal side relative to the annular roll portion toward the proximal side while supporting the annular roll portion by keeping a holder in abutment against a proximal side portion of the annular roll portion after the annular roll portion is formed by rolling the tubular net radially outward or inward. Thus, the annular roll portion has more even size and shape.

According to another aspect of the present invention, there is provided a container packing filler production method, which includes a first step of fitting a stretchable tubular net around a columnar support member, a second step of folding a distal portion of the net radially outward or inward by a plurality of guide members disposed circumferentially of the net while moving the guide members toward a net proximal side axially relative to the support member, whereby the net is rolled up radially outward or inward to form an annular roll portion, and a third step of tightening the annular roll portion by drawing a portion of the net projecting from the annular roll portion to the proximal side relative to the annular roll portion toward the proximal side while supporting the annular roll portion by keeping a holder in abutment against a proximal side portion of the annular roll portion after the annular roll portion is formed. Here, the guide members may have the same construction as the rolling means of the production apparatus disclosed in Patent Document 2 or the aforementioned circular rotation members. Alternatively, the guide members may be provided together with the circular rotation members, and may be cooperative with the circular rotation members to roll up the net.

The annular roll portion supported by the holder is preferably held by an end portion of the support member, but may be spaced away from the end portion of the support member when the annular roll portion is tightened. The net portion projecting from the annular roll portion to the proximal side is preferably drawn by a tightening mechanism having a gripper which holds the projecting net portion. The gripper may be adapted to permit slippage of the net according to tension acting on the net. Thus, the slippage is permitted when great tension acts on the net, thereby preventing the net portion from being further drawn. This prevents damage and breakage of the net. However, the gripper is not necessarily required to permit the slippage.

The production methods described above may further include a fourth step of binding a proximal end portion of the net formed by cutting the net portion projecting from the annular roll portion to the proximal side at a predetermined axial position to close the proximal end portion after the third step. Thus, a multiplicity of products can be produced by sequentially supplying an elongated string-like net. This makes it possible to automate the production line for mass production, thereby reducing costs. The net portion projecting from the annular roll portion to the proximal side may be first bound at the predetermined axial position, and then cut the resulting bound portion. Where an unloading chuck for unloading the annular roll portion after the cutting in the fourth step includes a heater mechanism such as a high frequency heater, the proximal end portion of the net can be bound when the product is unloaded. Thus, the production line can be further automated for mass production, thereby reducing the costs.

In the second step, an axially intermediate portion of the net present adjacent an end of the support member on the net proximal side is preferably held by the end of the support member on the net proximal side. Thus, the net can be reliably rolled up to a predetermined position while being prevented from slipping off from the end of the support member at the final stage of the step of rolling up the net by the circular rotation members and/or the guide members.

The inventive production methods described above are preferably implemented by using the following rolling apparatus.

An inventive tubular net rolling apparatus includes a columnar support member around which a stretchable tubular net is fitted, a circular rotation member which forcibly folds a distal portion of the net fitted around the support member radially outward or inward, and a driver which drives the circular rotation member toward a net proximal side axially of the net, whereby the net is rolled up radially outward or inward with the distal portion thereof folded by circular rotation and axial movement of the circular rotation member to form an annular roll portion.

The support member preferably has a cylindrical shape having a diameter such that the fitted tubular net is radially stretched, and may have a hollow inside. The support member may be vertically disposed or suspended, or may be horizontally disposed. One end of the support member may be fixed to a planar base or a frame-like base, so that the tubular net can be fitted onto the support member from a distal end of the support member. The support member preferably has a distal tapered shoulder (i.e., on the net proximal side) having a diameter which decreases toward the distal end. Thus, the distal portion of the net is guided by the distal shoulder, so that the net can be more smoothly fitted around the support member.

The apparatus preferably further includes a holder which is capable of changing its attitude between a hold attitude in which an axially intermediate portion of the net present adjacent the end of the support member on the net proximal side is held by the end of the support member on the net proximal side and a release attitude in which the axially intermediate portion of the net is released. More specifically, the attitude of the holder is changed, for example, by changing the position of the holder by parallel shift, rotating the holder, deforming the holder or changing the physical property of the holder. These attitude changing methods may be used either alone or in combination, as long as a net holding/releasing operation can be performed. It is not necessary to firmly fix the net for holding the net, but the net should be prevented from slipping off from the support member when the net is rolled up.

The inventive rolling apparatus may further include a holder which is brought into abutment against a proximal side portion of the formed annular roll portion, and a tightening mechanism which tightens the annular roll portion by drawing a portion of the net projecting from the annular roll portion to the proximal side relative to the annular roll portion toward the proximal side while supporting the annular roll portion by the holder. This holder may be provided separately from the aforementioned holder which releasably holds the axially intermediate portion of the net, or may double the aforementioned holder.

Another inventive tubular net rolling apparatus includes a columnar support member around which a stretchable tubular net is fitted, and a guide member which is brought into abutment against a distal portion of the net fitted around the support member to guide the net so as to fold the distal portion of the net radially outward or inward, and further includes a first driver which drives the guide member toward a net proximal side axially of the net, a holder which is configured to form an annular roll portion by rolling the net radially outward or inward by axial movement of the guide member and is brought into abutment against a proximal side portion of the formed annular roll portion, and a tightening mechanism which tightens the annular roll portion by drawing a portion of the net projecting from the annular roll portion to the proximal side relative to the annular roll portion toward the proximal side while supporting the annular roll portion by the holder. The holder is capable of changing its attitude between a hold attitude in which an axially intermediate portion of the net present adjacent an end of the support member on the net proximal side is held by the end of the support member on the net proximal side and a release attitude in which the axially intermediate portion of the net is released.

The tightening mechanism may have any of various conceivable constructions. For example, the tightening mechanism may include a weight member to be inserted into the net, an annular weight holder which receives the weight member, and a second driver which drives the weight holder axially of the support member. Thus, a portion of the net present between the weight member and the weight holder is held between the weight member and the weight holder by the weight of the weight member, and is drawn to the net proximal side with respect to the support member by driving the second driver. Therefore, the net is reliably and speedily rolled up with a simplified construction. In this construction, the support member preferably has an axis extending vertically, and the weight member is preferably disposed above the support member. The tightening mechanism preferably further includes a third driver which drives the support member upward with respect to the weight holder, and the weight member is preferably rested on an upper end of the support member to be spaced upward from the weight holder when the support member is driven upward. Thus, the third driver is driven, as required, to cause the weight member to hold and release the net. The weight member preferably has a maximum diameter which is sufficient to stretch the net radially outward.

The rolling apparatus may further include a twist detecting device which detects twist of the tubular net on the net proximal side with respect to the weight member, and an untwisting mechanism which untwists the tubular net by rotatively driving the weight member based on a result of the detection by the twist detecting device. Thus, the twist of the net is detected by the detecting device, and the net is untwisted by the rotative driving of the weight member before the net is fitted around the support member. It is more preferred that the weight member and the weight holder are driven to be rotated in the same direction with the net being held therebetween to prevent the twist of the net. The weight member is rotatively driven via the weight holder.

The maximum diameter of the weight member is preferably generally equal to the outer diameter of the support member. Thus, the diameter of the net is preliminarily increased by passing the net over the weight member. Therefore, the tubular net is untwisted before the net is fitted around the support member, so that the state of the net fitted around the support member is optimized. A preliminary diameter increasing member having an outer peripheral surface over which the net passes to preliminarily increase the diameter of the net may be separately provided. The preliminary diameter increasing member is preferably provided just before a position at which the net is fitted around the support member.

Where the weight member is provided, the preliminary diameter increasing member may be provided before or behind the weight member.

The rolling apparatus may further include a catch which holds the distal portion of the tubular net at a net holding position between the support member and the tightening mechanism and is driven axially of the net so that the net is fitted around the support member as extending over a predetermined axial length from the net holding position. With this arrangement, after a single product having the annular roll portion is produced and then the net portion projecting from the annular roll portion to the proximal side is cut, an open end of the net present between the support member and the tightening mechanism is immediately held and fitted over the support member by the catch, whereby a portion of the net to be subsequently processed is fitted around the support member.

The construction of the tightening mechanism is not limited to the aforementioned construction, but the tightening mechanism may utilize a magnetic force generated by an electric magnet instead of the weight of the weight member to press the weight member toward the weight holder and move the weight member away from the weight holder. Particularly, where the support member is horizontally disposed, the weight member is effectively actuated by the magnetic force.

The support member preferably has a recess provided in an outer peripheral surface thereof as extending axially thereof, and the circular rotation member is partly inserted in the recess. The term "recess" to be herein used is intended to include a bottomed groove and a slit. With this arrangement, the circular rotation member is more reliably brought into contact with the distal portion of the net to fold the distal portion of the net.

The circular rotation member is preferably an annular endless belt, which has a circular orbit extending radially outward and inward of the outer peripheral surface of the support member.

The circular rotation member preferably has a surface having undulations for easily catching the distal portion of the net. Where the circular rotation member is the annular belt, the annular belt has projections arranged in staggered relation on the surface thereof.

Alternatively, the support member may have a smooth outer peripheral surface, or may have an outer peripheral surface subjected to a surface finishing process or a surface treatment so as to cause friction or resistance on the net when the net is moved axially relative to the support member in a net dislodging direction but not to cause friction or resistance on the net when the net is fitted around the support member.

Further, the inventive rolling apparatus may include a net cutting mechanism which cuts a portion of the net present on the proximal side with respect to the formed annular roll portion. The cutting mechanism may be a mechanical cutting mechanism such as a cutter, an electric heating wire which is heated to a temperature not lower than the melting point of the net to burn off the net, or any other conventionally known cutting means.

Further, the inventive rolling apparatus may include a net fusion-bonding mechanism which melts and solidifies an axially intermediate portion of the net present on the proximal side with respect to the formed annular roll portion. Preferably, the portion of the net to be cut by the cutting mechanism is more distant from the annular roll portion to the proximal side than the portion to be fusion-bonded by the fusion-bonding mechanism.

According to further another aspect of the present invention, there is provided a container packing filler production method, which uses any of the aforementioned inventive tubular net rolling apparatuses to produce a container packing filler having an annular roll portion by rolling a net radially outward or inward.

An ordinary plastic material such as polyethylene, polypropylene, polyvinyl chloride, polyvinylidene chloride, polyester, polyvinyl acetate or nylon may be used as a material for the tubular net. A foam of any of these materials is also usable. The line diameter of the net is desirably not greater than 5 mm in consideration of the fact that the packing filler is used for packing solid pieces in a small-size package container. It is practically preferred that apertures of the net each have an edge length of not greater than 20 mm. The solid pieces are unlikely to pass through the apertures, because the packing filler is compressed in the package container in use. The shape of each of the apertures is not limited to a rhombic shape, but may be a square, rectangular, triangular, hexagonal or round shape.

Effects of the Invention

According to the present invention, even if a net material based on the standards (e.g., an LDPE/L-LDPE blending ratio), a per unit area weight, the number of threads, a folding diameter and a draw ratio are changed, there is no need to change the model of the apparatus, but the tubular net can be correctly and speedily rolled up into the bulk or ball shape by controlling a relationship between the rotation speed of the circular rotation member and the driving speeds of the respective drivers. Further, the size and the shape of the bulk-shaped or ball-shaped body can be properly controlled to improve the productivity and the yield of the product. Thus, the container package filler having the annular roll portion can be mass-produced at lower costs. Particularly, the tubular net has an open end, so that the packing filler having the annular roll portion can be mass-produced from the continuously supplied tubular net.

DESCRIPTION OF REFERENCE CHARACTERS

Figure 1:
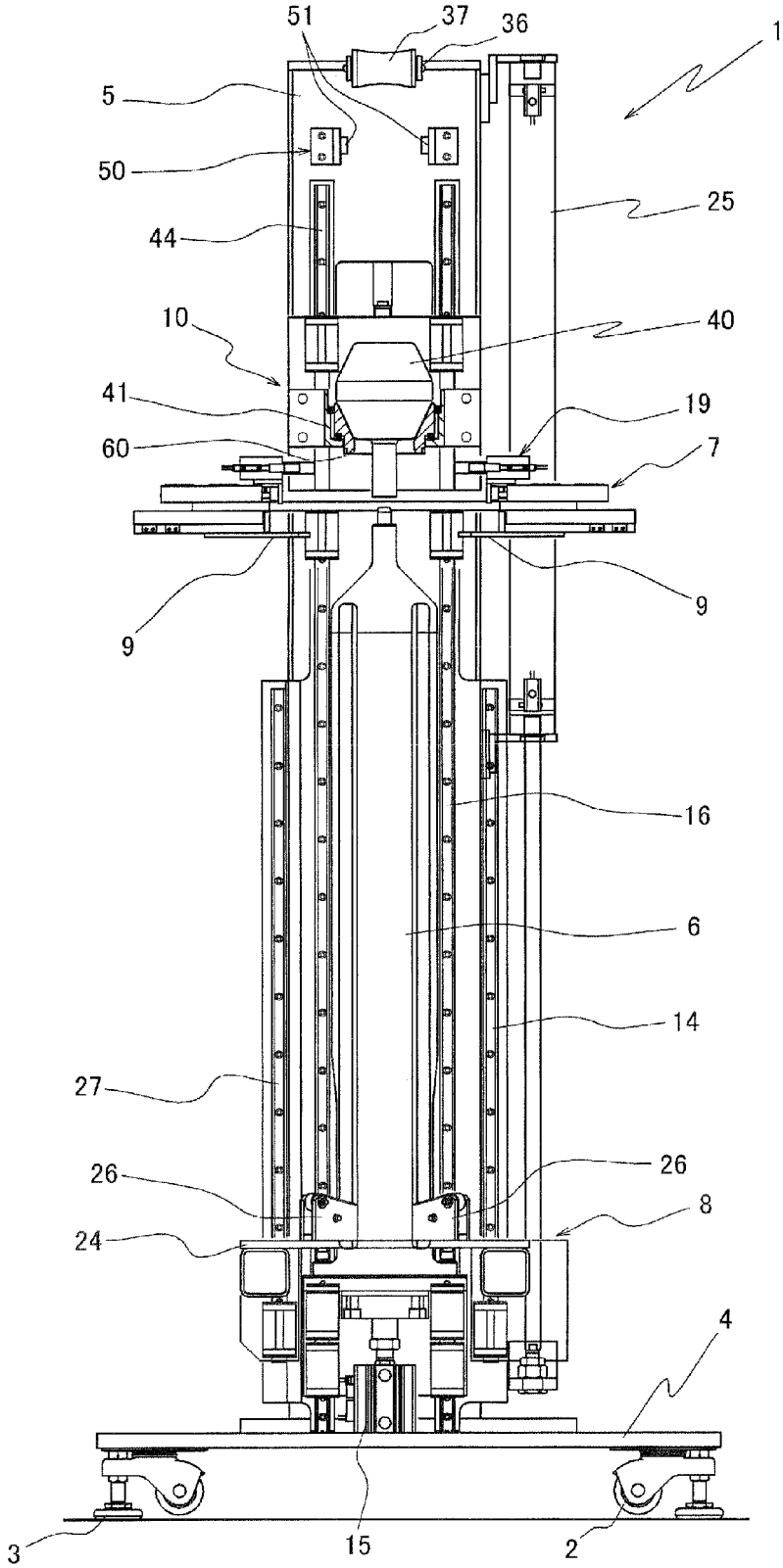
FIG. 1 is an overall front view of a net rolling apparatus according to one embodiment of the present invention.

1: Tubular net rolling apparatus
6: Support member
9: Holders
30: Circular rotation members (roller belts)
N: Tubular net
C: Annular roll portion

BEST MODE FOR CARRYING OUT THE INVENTION

Preferred embodiments of the present invention will hereinafter be described with reference to the attached drawings.

FIGS. 1 to 6 are overall views of a tubular net rolling apparatus 1 according to one embodiment of the present invention, and sectional views of major portions of the apparatus. The apparatus 1 includes a base plate 4 (base) having casters 2 and installation legs 3 provided on a bottom surface thereof, a frame 5 provided upright on the base plate 4, a hollow cylindrical support member 6, a net fitting mechanism 7 which fits a net around the support member 6, a rolling mechanism 8 which rolls up the net fitted around the support member 6 radially outward, holders 9, a tightening mechanism 10 which tightens an annular roll portion by drawing a portion of the net projecting from the annular roll portion to a proximal side relative to the annular roll portion toward the proximal side with the annular roll portion being supported by the holders 9, a twist detecting device 50 which detects twist of the net before the net is fitted around the support member 6, and an untwisting mechanism 60 which untwists the tubular net based on the result of the detection by the twist detecting device 50.

A roller 37 is rotatably attached to an upper end of the frame 5 via a support arm 36. The roller 37 is located above a weight member 40 to be described later, and adapted to guide a net paid out from a net roll.

Figure 7:
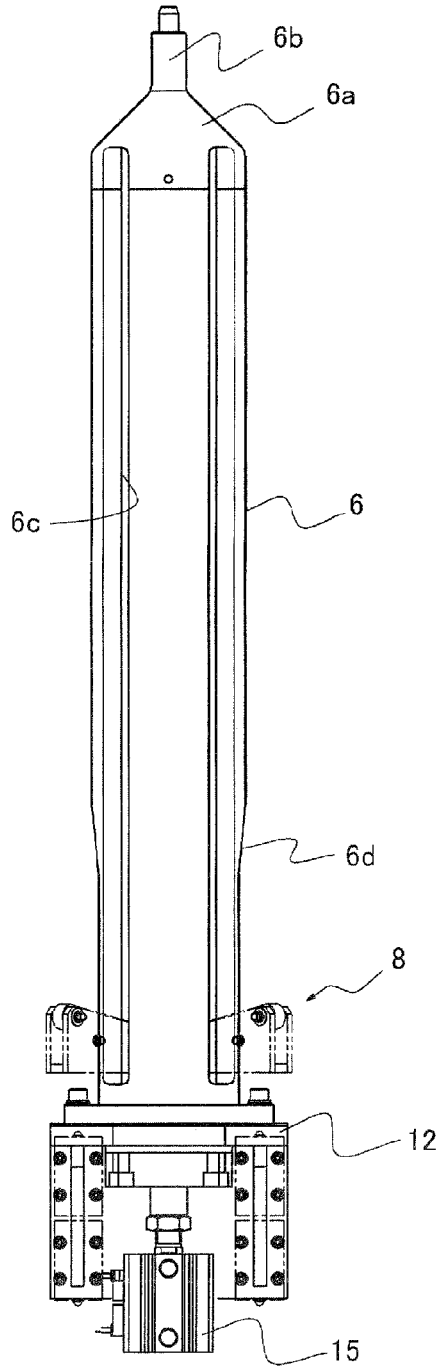
FIG. 7 is an enlarged front view of a support member of the apparatus.
Figure 8:
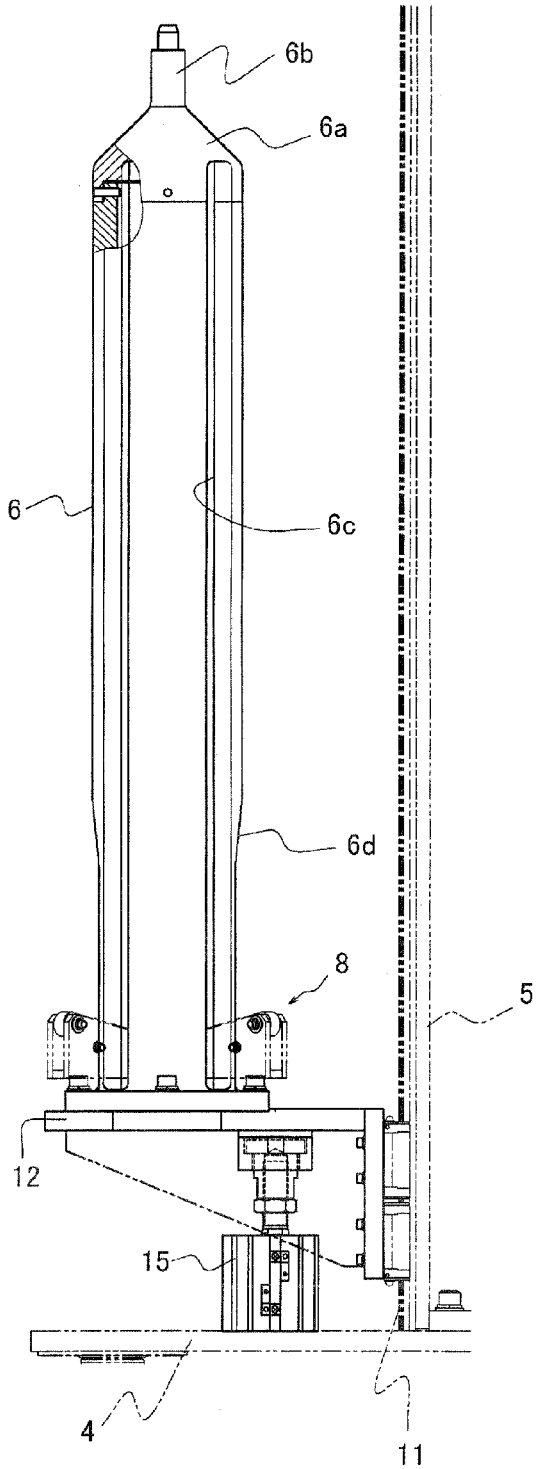
FIG. 8 is an enlarged side view of the support member.

As also shown in FIGS. 7 and 8, the support member 6 includes a smaller diameter shaft portion **6*b* provided at a distal end thereof via a tapered shoulder 6*a*. The support member 6 has a plurality of slits (recesses) 6*c* (four slits in the figures) provided in an outer peripheral surface thereof as axially extending along substantially the entire length thereof. Roller belts 30 to be described later are respectively provided in the slits 6*c* so as to pass through the slits 6*c* radially outward and inward. The roller belts 30 (circular rotation members) each have a radially inward portion inserted in the slit 6*c*. The support member 6 is disposed on a seat 12 provided on the frame 5 in an axially reciprocally movable manner via rails 11 with its axis vertically extending. An actuator 15 (third driver) which axially reciprocally drives the support member 6 is provided between the seat 12 and the base plate 4**.

The support member 6 has a tapered portion **6*d* provided on an axially intermediate portion thereof as having a diameter which decreases toward a proximal end thereof (toward a lower side in the figures). On a smaller diameter portion of the support member 6 which is continuous from the tapered portion 6*d*** and slightly smaller in diameter, the fitted net is circumferentially slacked, so that a distal portion of the net can be more reliably folded to form the annular roll portion at the beginning of the rolling.

Figure 9:
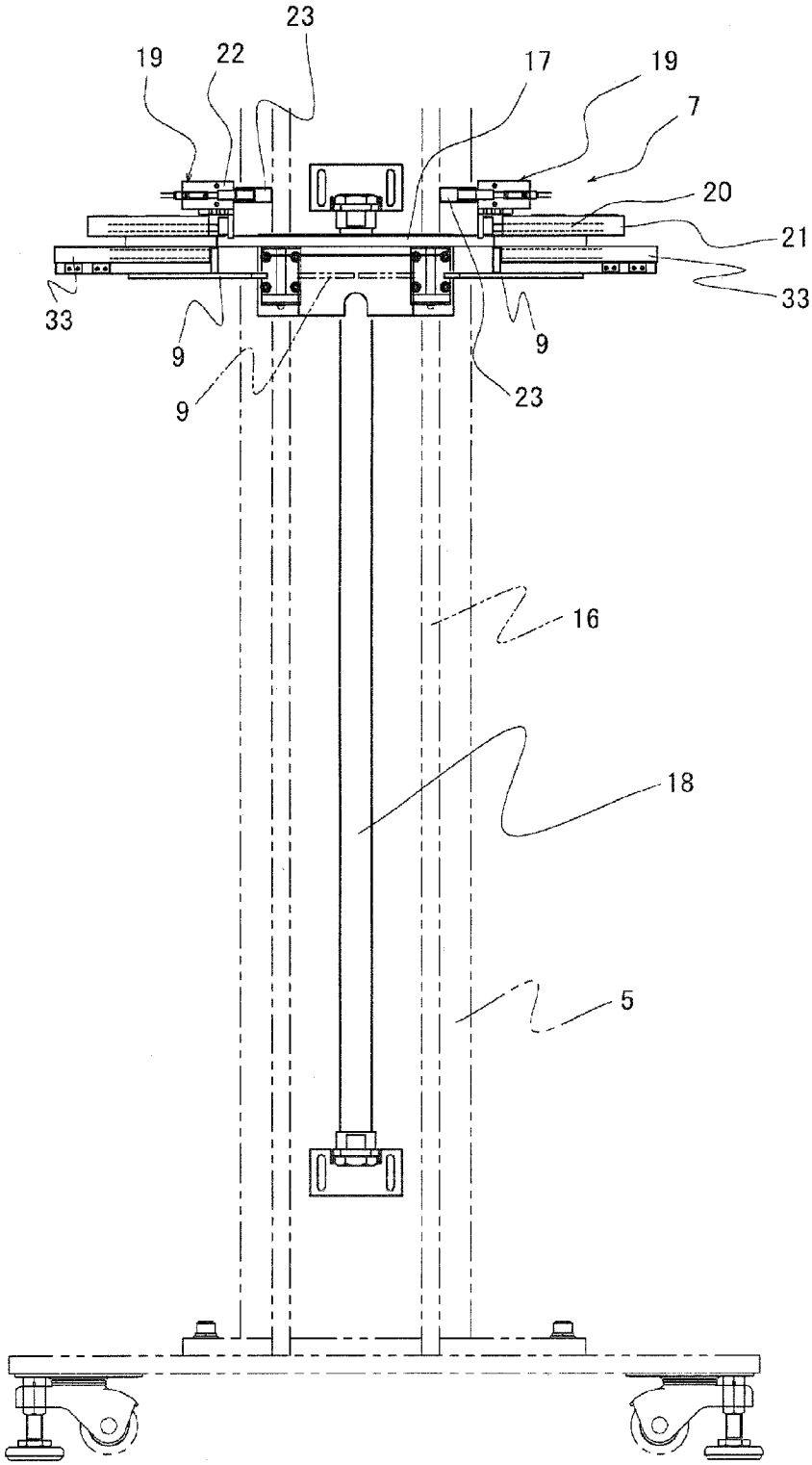
FIG. 9 is an enlarged front view of a net fitting mechanism and a holder of the apparatus.
Figure 10:
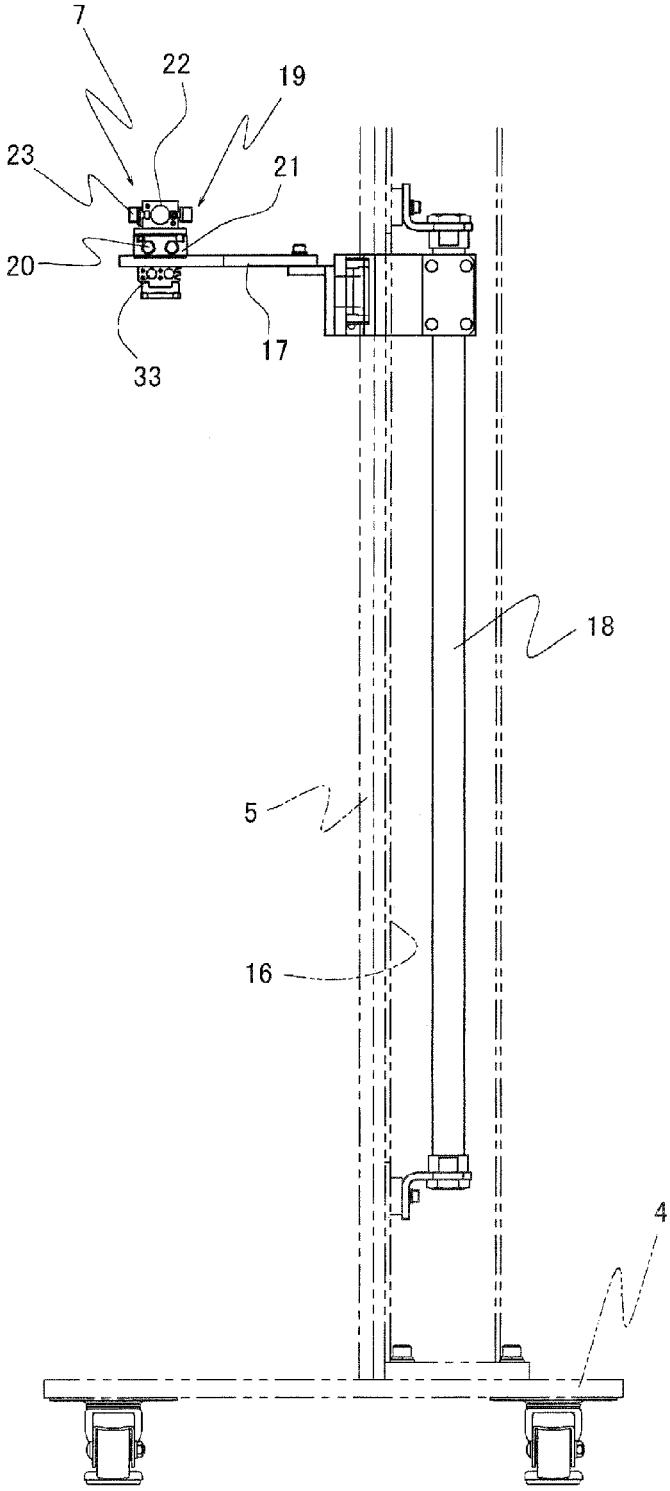
FIG. 10 is an enlarged side view of the net fitting mechanism and the holder.

As also shown in FIGS. 9 and 10, the net fitting mechanism 7 includes a movable base 17 provided on the frame 5 via rails 16 so as to be reciprocally movable axially of the support member 6, an actuator 18 (fourth driver) which reciprocally drives the movable base 17 axially of the support member 6, and a plurality of catches 19 provided on the movable base 17.

Figure 11:
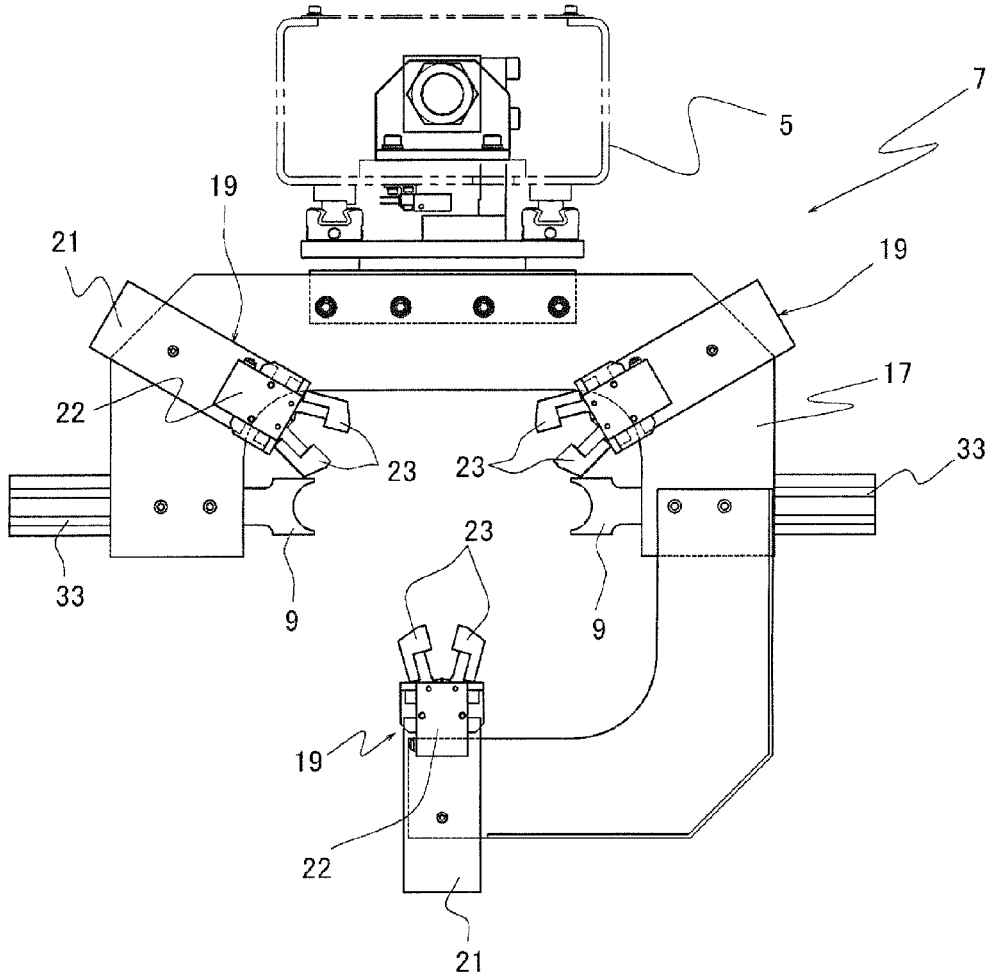
FIG. 11 is an enlarged plan view of the net fitting mechanism illustrated as having three catches.

The catches 19 each include a first actuator 21 which radially reciprocally moves an expansion rod 20 projecting radially inward, a second actuator 22 attached to a distal end of the expansion rod 20, and a pair of right and left arms 23 which are driven to be opened and closed by the second actuator. The first actuator 21 is fixed to the movable base 17. At least one catch 19 may be provided, but two catches 19 are preferably provided in diametrically opposed relation as shown in FIGS. 1 to 10. More preferably, three catches 19 are circumferentially provided as shown in FIG. 11. Further, four or more catches 19 may be provided.

Although a rodless cylinder is used as the actuator 18 in the embodiment shown in the figures, a hydraulic cylinder having an expansion rod and a motor may be used. In the embodiment shown in the figures, the rails 11 for guiding the support member 6 double as the rails 16 for the net fitting mechanism 7, but these rails 11, 16 may be separately provided.

Figure 2:
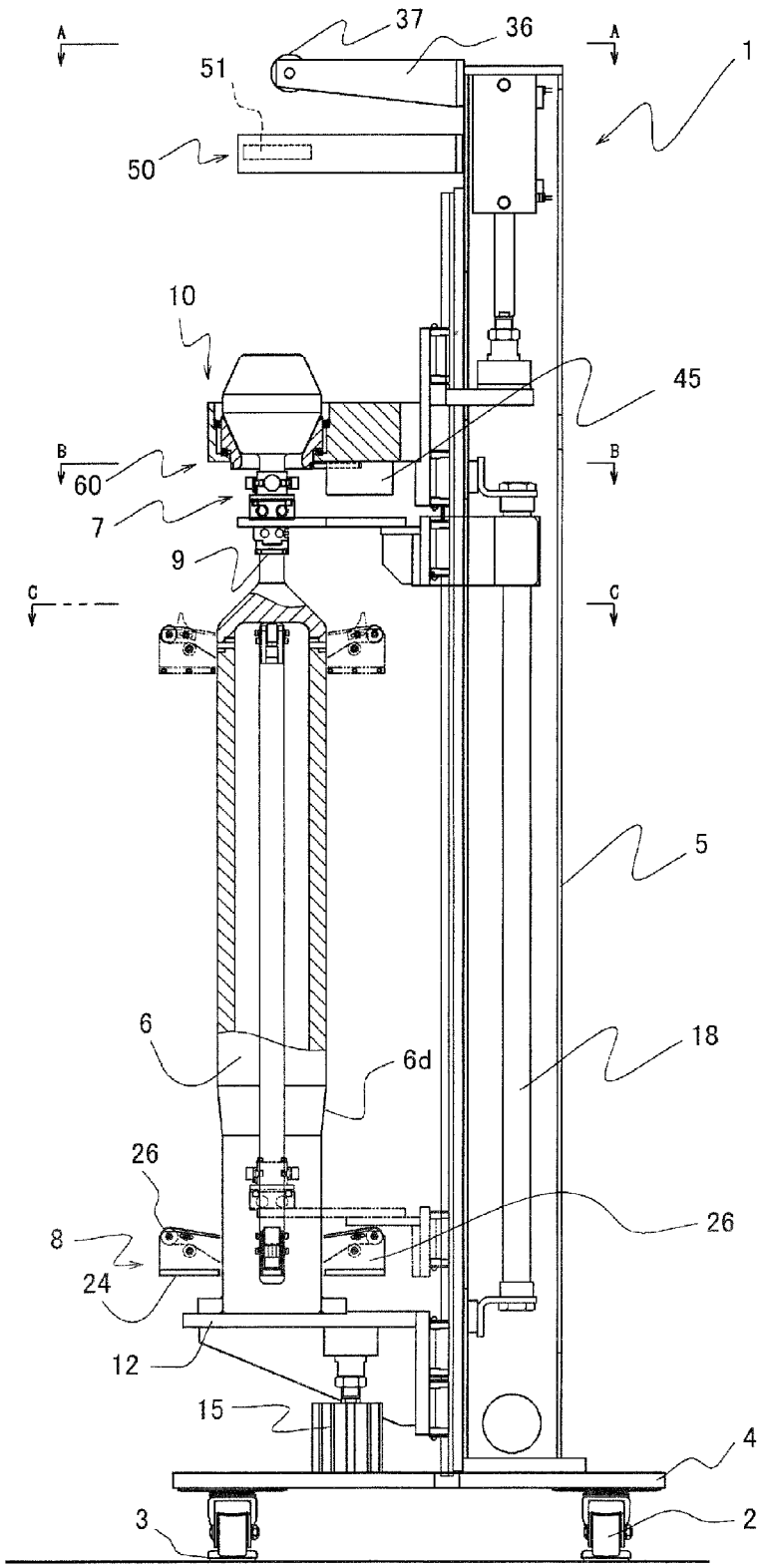
FIG. 2 is an overall side view illustrating the apparatus partly in section.
Figure 3:
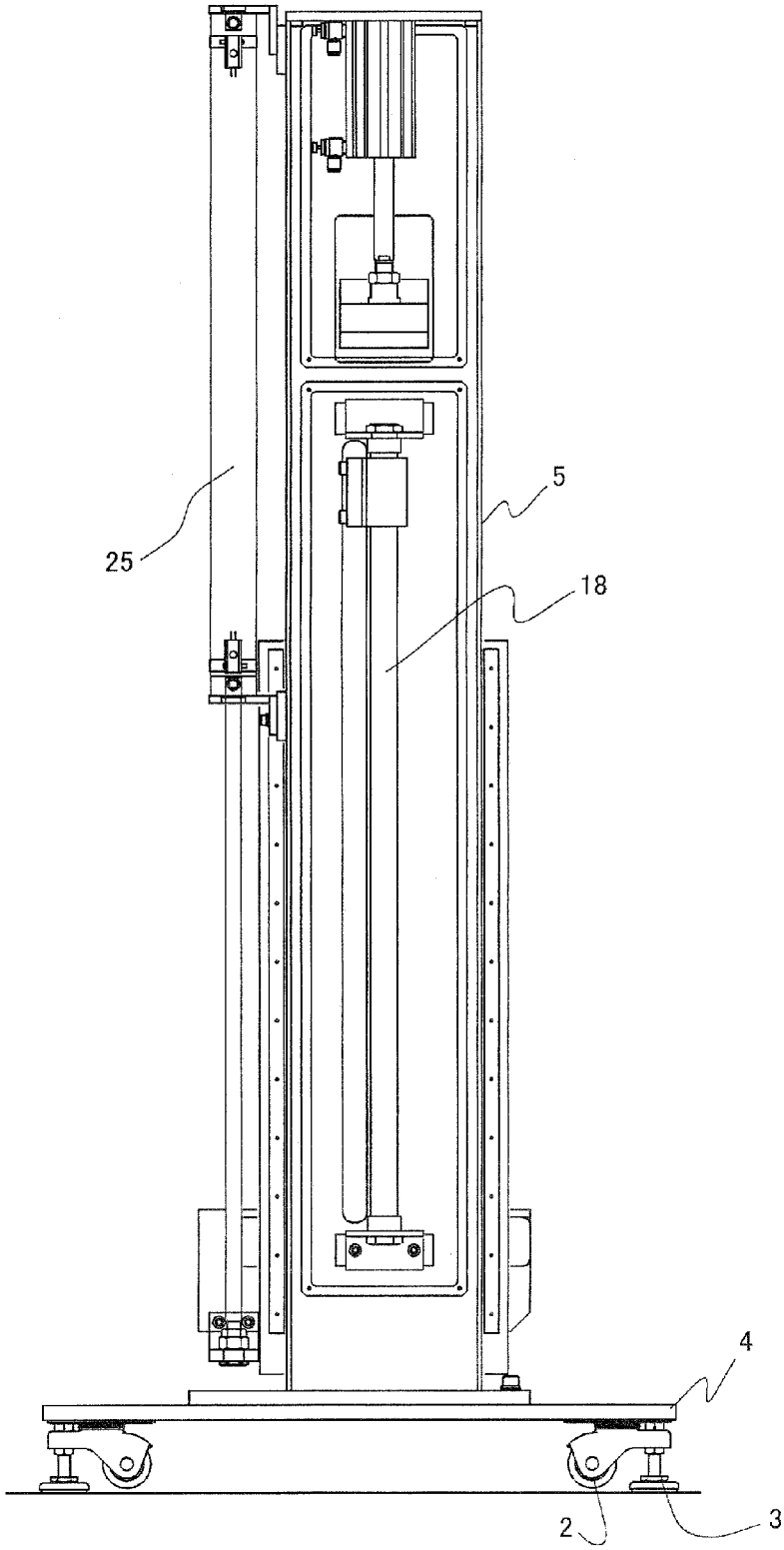
FIG. 3 is an overall rear view of the apparatus.
Figure 4:
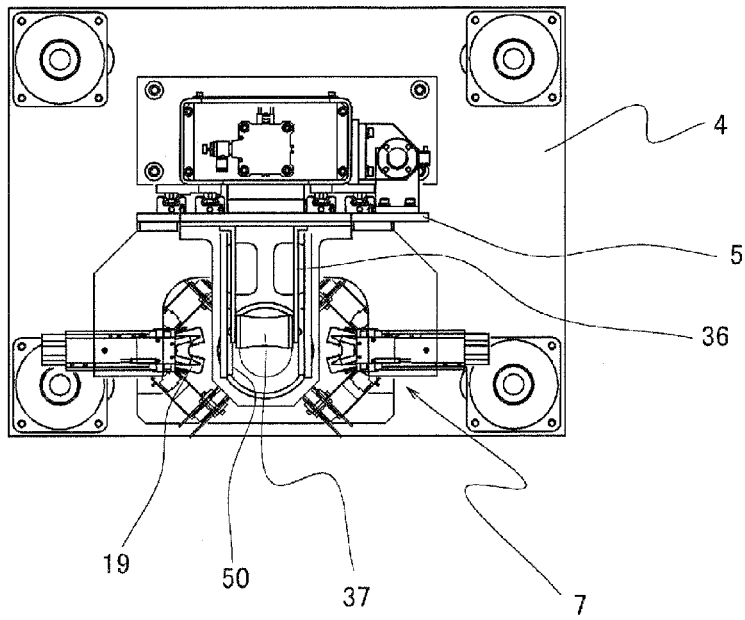
FIG. 4 is a diagram as seen in an arrow direction A-A in FIG. 2.
Figure 5:
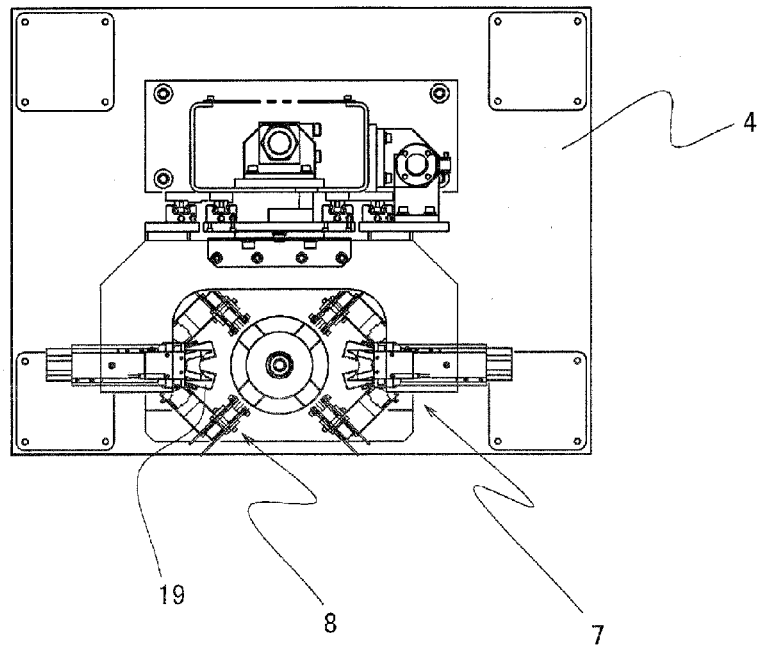
FIG. 5 is a sectional view as seen in an arrow direction B-B in FIG. 2.
Figure 6:
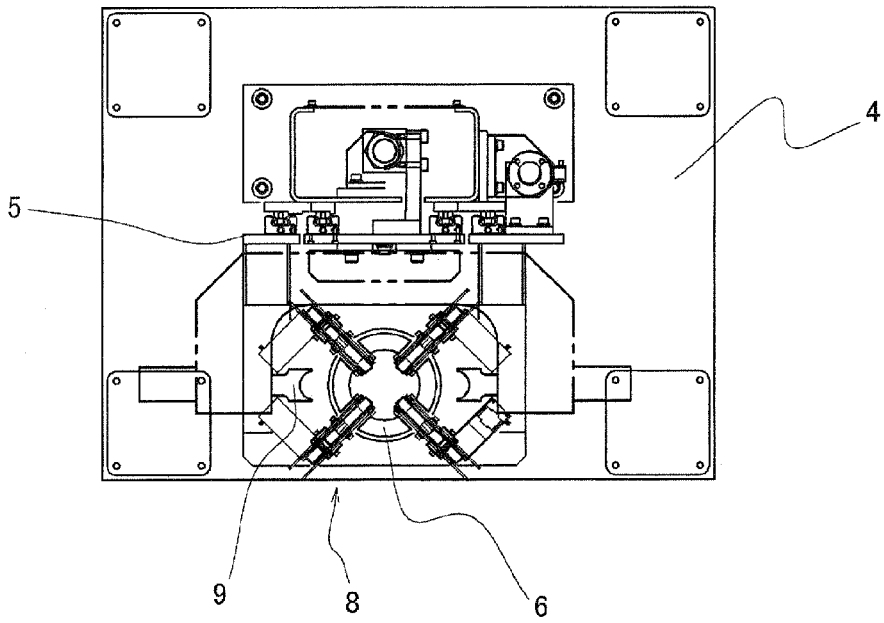
FIG. 6 is a sectional view as seen in an arrow direction C-C in FIG. 2.
Figure 12:
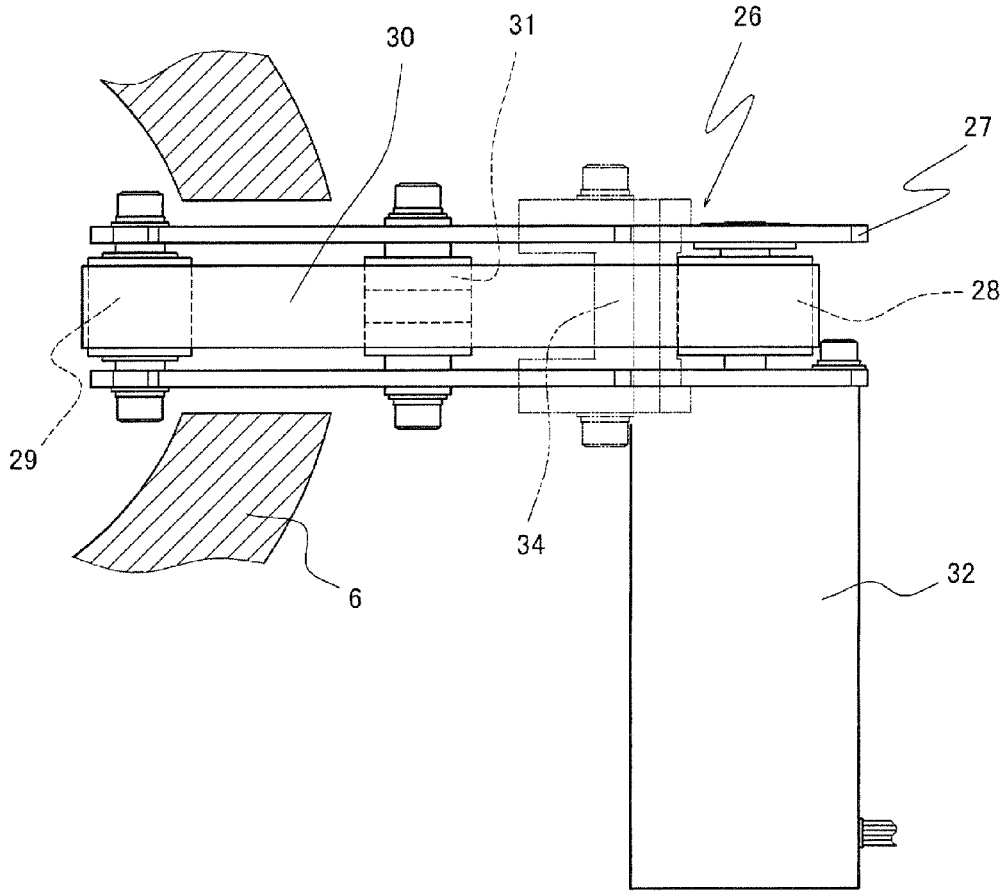
FIG. 12 is an enlarged plan view of a roller belt unit of the apparatus.
Figure 13:
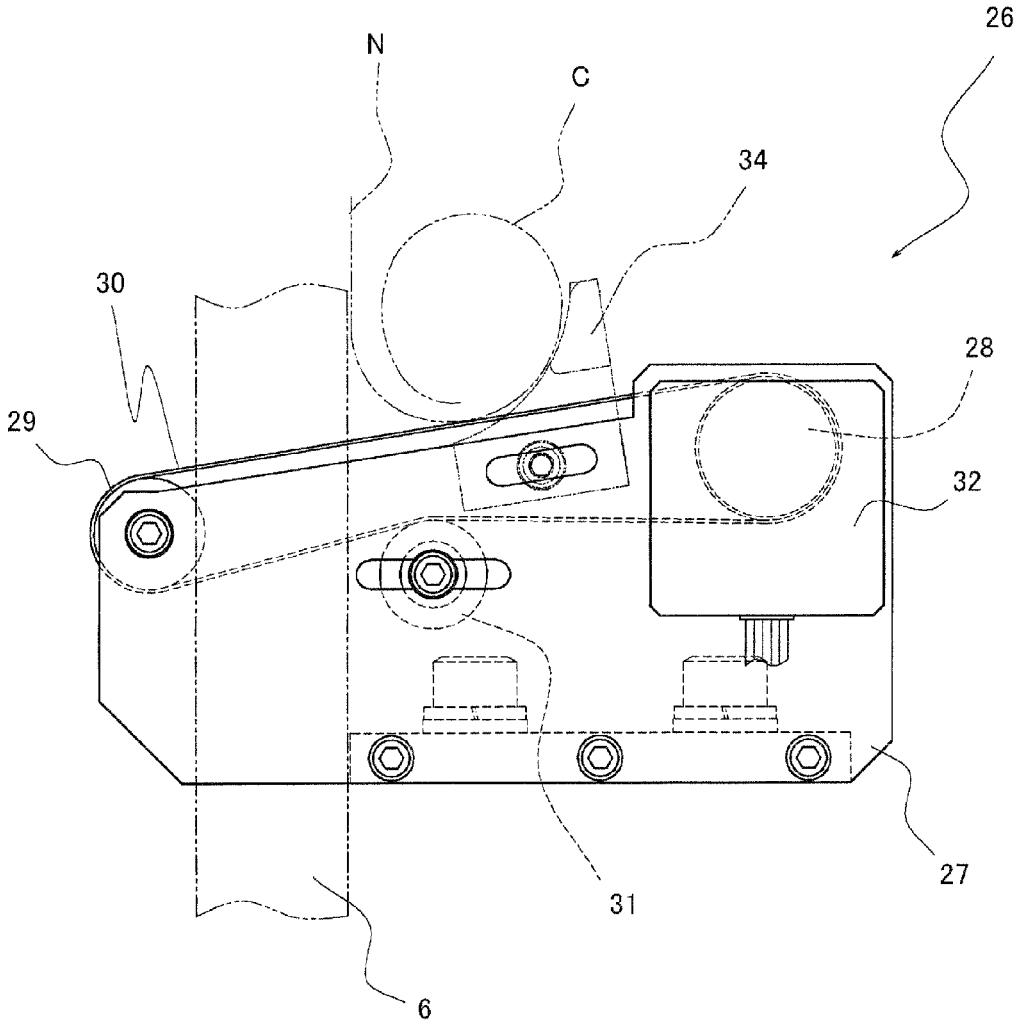
FIG. 13 is an enlarged front view of the roller belt unit.
Figure 14:
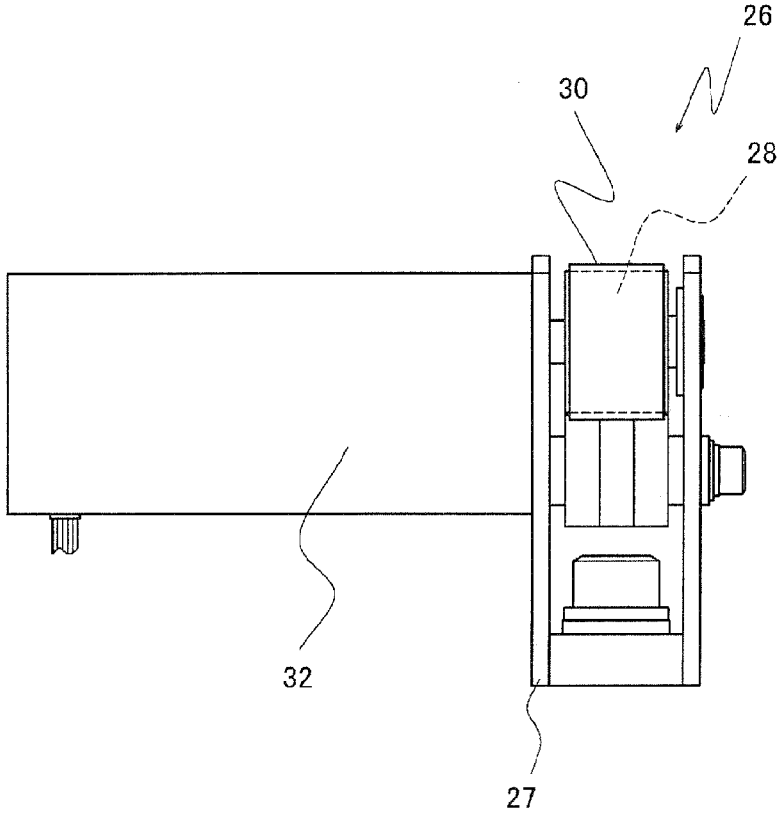
FIG. 14 is an enlarged side view of the roller belt unit.

As shown in FIGS. 1 to 3, the rolling mechanism 8 includes a movable base 24 provided on the frame 5 via rails 14 so as to be reciprocally movable axially of the support member 6, an actuator 25 (first driver) which axially reciprocally drives the movable base 24, and four roller belt units 26 provided on the movable base 24. As also shown in FIGS. 12 to 14, the units 26 each include a pair of right and left side plates 27, a driving roller 28 and a driven roller 29 rotatably provided between the side plates 27, an annular endless roller belt 30 (circular rotation member) entrained between the driving roller 28 and the driven roller 29, a regulation roller 31 which regulates the tension of the belt 30, and a motor 32 which rotatively drives the driving roller 28. The four units 26 are respectively disposed in association with the four slits **6*c* provided in the support member 6. The driven roller 29 is located radially inward of the outer peripheral surface of the support member 6, and the driving roller 28 is located radially outward of the outer peripheral surface of the support member 6. Thus, the circular orbit of the roller belt 30 extends between radially outward and inward sides of the outer peripheral surface of the support member 6**.

The roller belt 30 is driven by the driving roller 28 to be circularly rotated so that a portion of the roller belt 30 opposed to the distal portion of the net fitted around the support member 6 moves from the radially inward side to the radially outward side (on the upper side of a circulation path). Further, a surface of the portion of the belt 30 opposed to the distal portion of the net is inclined toward a proximal portion of the net (upward in the figures) in a direction from the radially inward side to the radially outward side.

Figure 15:
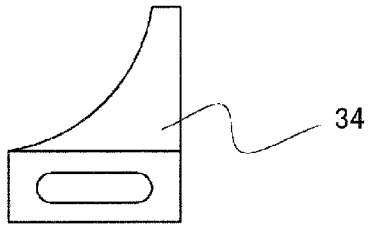
FIG. 15 is a front view illustrating an example of a guide member.
Figure 16:
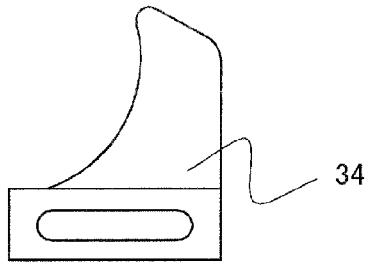
FIG. 16 is a front view illustrating another example of the guide member.
Figure 17:
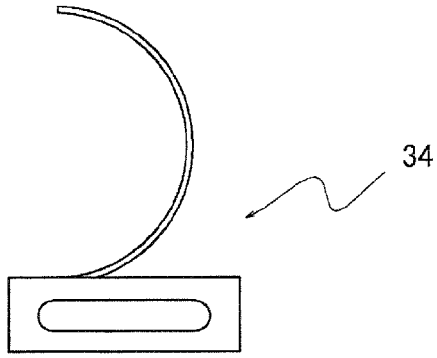
FIG. 17 is a front view illustrating further another example of the guide member.

In order to control the shape and the size of the annular roll portion to be formed, the units 26 may each include a guide member 34 which guides an outer periphery of the annular roll portion. The guide member 34 is attached and fixed to the right and left side plates 27 via elongated openings of the side plates for flexible adjustment of the attachment angle and the attachment position thereof. Further, as shown in FIGS. 15 to 17, guide members having different shapes and curvature radii may be used as the guide member 34 for replacement according to a material for the net, and the size and the shape of a product required to be produced.

In the embodiment shown in the figures, the holders 9 are each attached to the movable base 17 of the net fitting mechanism 7 via an actuator 33, and moved between radially outward and inward positions by the actuator 33. As shown in FIGS. 9 to 11, the holders 9 are paired to be disposed in diametrically opposed relation. When the paired holders 9 are moved radially inward by the actuators 33, the paired holders 9 surround the distal smaller diameter shaft portion 6*b* of the support member 6 to hold an axially intermediate portion of the net between the holders 9 and the smaller diameter shaft portion 6*b*. When the holders 9 are moved back to the radially outward positions, the net is released. When a tightening process to be described later is performed, the holders 9 are brought into abutment against a proximal side portion of the formed annular roll portion, thereby serving to hold the annular roll portion.

The catches 19 and the holders 9 are each retracted radially outward of the outer peripheral surface of the support member 6 when being moved to the radially outward positions.

Figure 18:
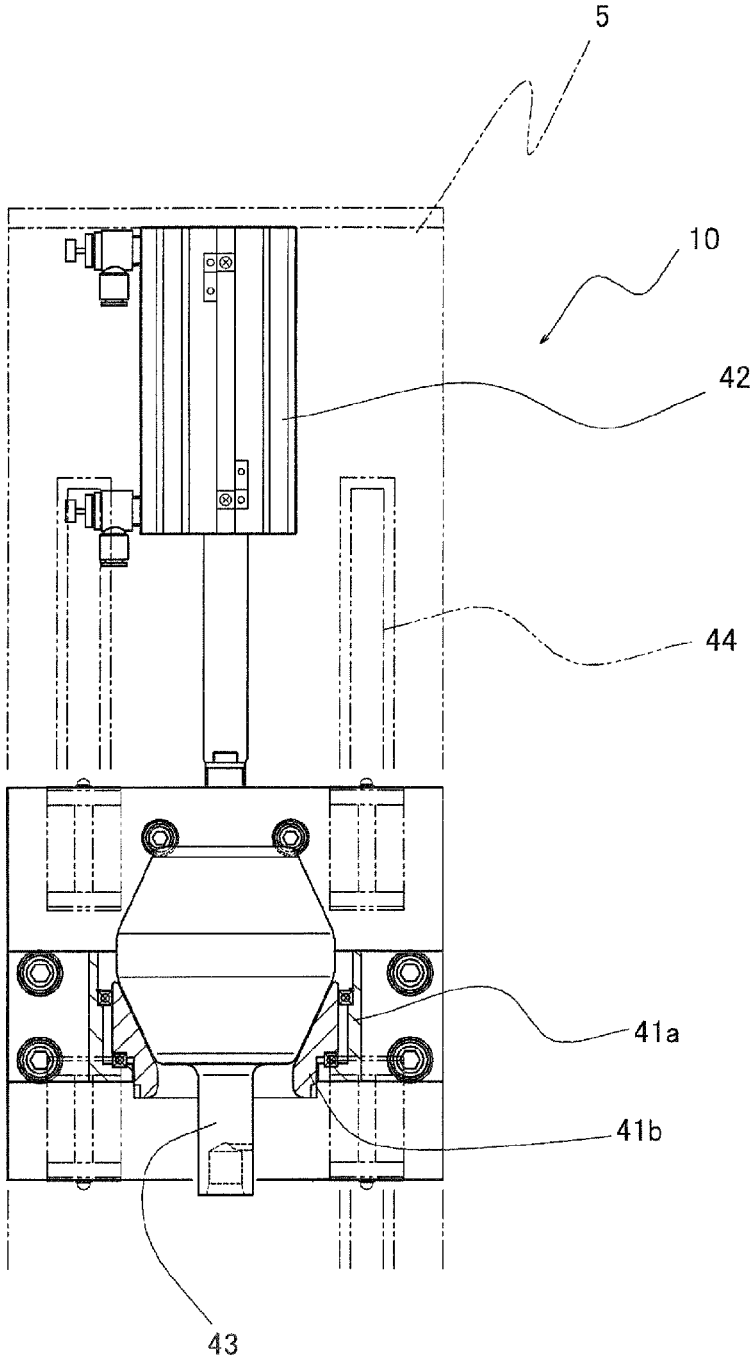
FIG. 18 is an enlarged front view illustrating a tightening mechanism of the apparatus.
Figure 19:
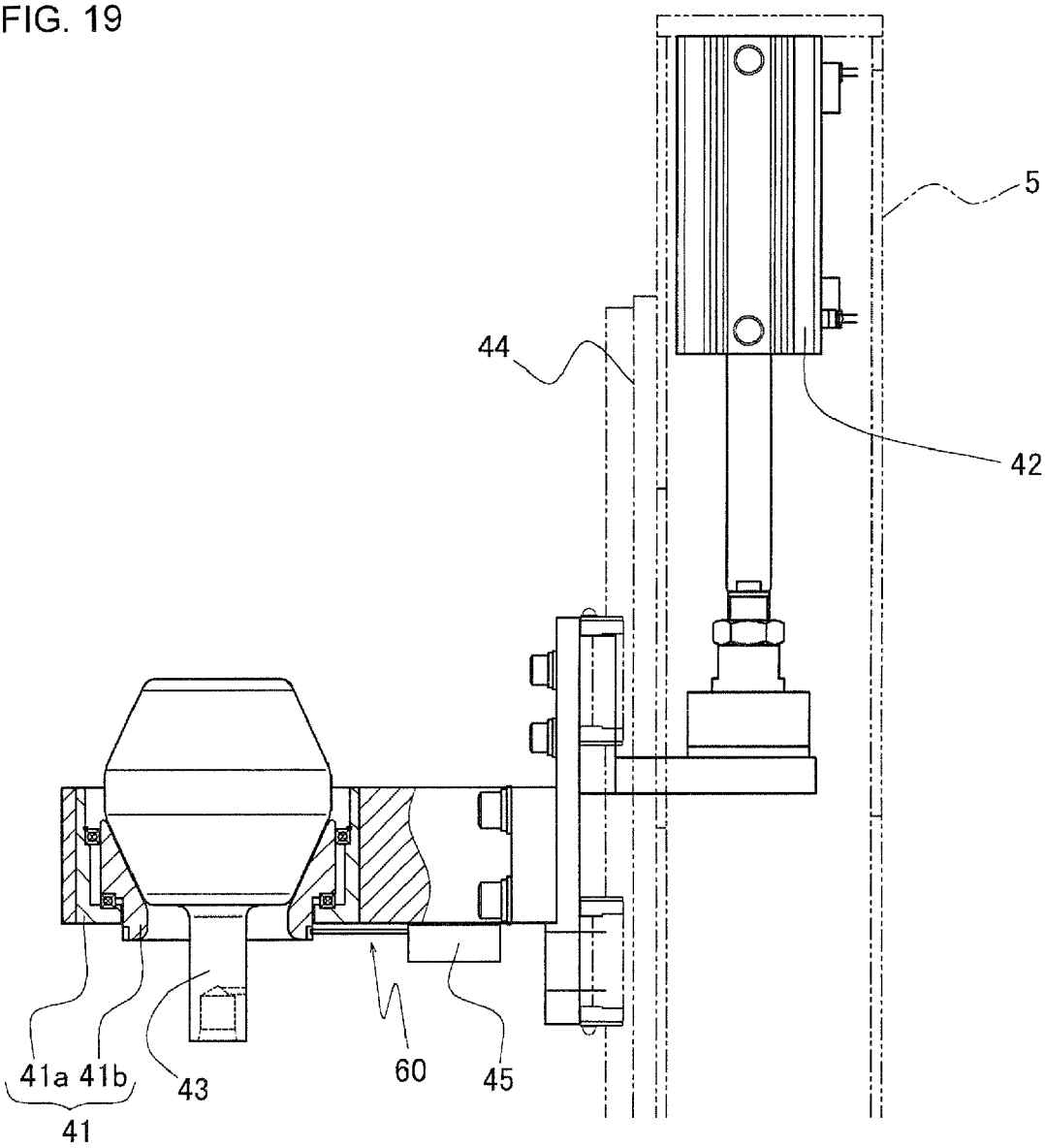
FIG. 19 is an enlarged side view of the tightening mechanism.
Figure 20:
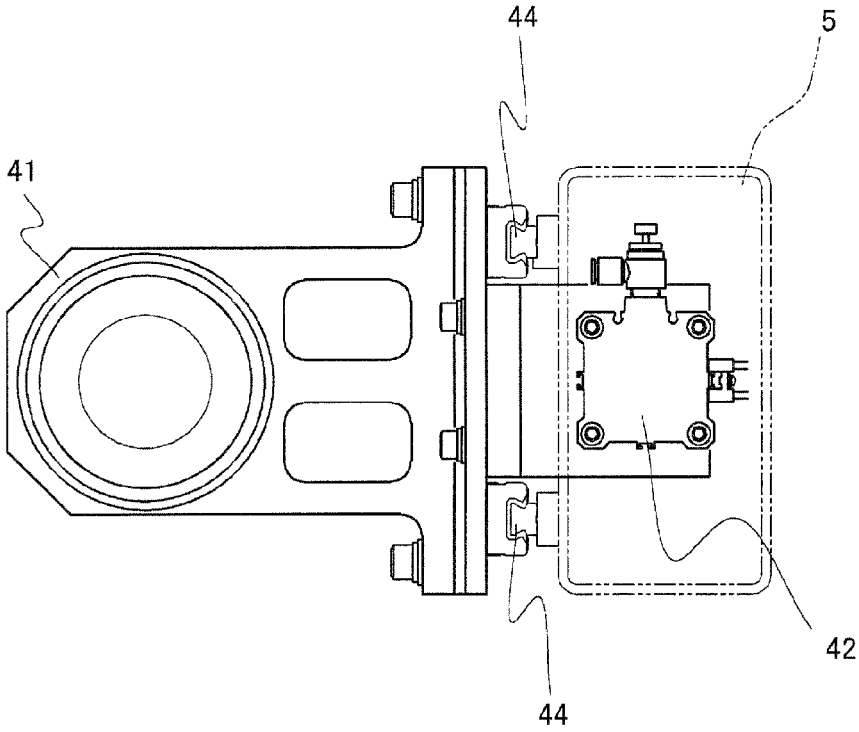
FIG. 20 is a plan view of the tightening mechanism.

The tightening mechanism 10 tightens the annular roll portion by drawing the net portion projecting from the formed annular roll portion to the proximal side relative to the annular roll portion toward the proximal side with the annular roll portion being supported by the holders 9. As shown in FIGS. 18 to 20, the tightening mechanism 10 includes the weight member 40 to be inserted into the net, an annular weight holder 41 which receives the weight member 40, and an actuator 42 (second driver) which drives the weight holder 41 axially of the support member 6.

The weight member 40 has an axially intermediate portion having substantially the same outer diameter as the support member 6, and tapered surfaces provided on axially opposite sides of the axially intermediate portion and having diameters which decrease toward axially opposite ends thereof. A smaller diameter shaft portion 43 projects from an end of the weight member 40 adjacent to the support member 6, and is engageable with the distal portion of the support member 6.

The weight holder 41 is attached to the frame 5 via rails 44 so as to be reciprocally movable axially of the support member 6, and has a weight receiving surface which is tapered to be conformable to the tapered surface of the weight member 40.

The weight member 40 is usually rested on the weight holder 41, so that the net can be fixed between the weight member 40 and the weight holder 41 by the weight of the weight member 40.

The weight member 40 is disposed above the support member 6 with the smaller diameter shaft portion 43 thereof being coaxial with the smaller diameter shaft portion 6*b* of the support member 6. The support member 6 is driven upward with respect to the weight holder 41, whereby the weight member 40 is rested on the upper end of the support member 6 to be moved upward away from the weight holder 41.

The weight member 40 may have a round shape or a spindle shape for feeding the net. However, the weight member 40 is preferably configured to have the tapered surface so as to more easily hold the net with an increased contact area with respect to the holder 41. The weight member preferably has a weight of about 3 to 6 kg, e.g., about 4.5 kg, which is properly determined according to the thrust of the actuator. The weight member may be made of a metal, or may be a plastic container filled with water. Further, the weight member may be adapted to be moved toward and away from the holder 41 by a magnetic force.

In the embodiment shown in the figures, the weight holder 41 includes a main body 41*a* attached and fixed to the frame 5, and a ring-shaped rotatable member 41*b* rotatably supported by the main body 41*a*. The rotatable member 41*b* has an inner peripheral surface serving as a tapered support surface which receives the weight member 40. Further, a driver 45 such as a motor for rotatively driving the rotatable member 41*b* is attached to the main body 41*a*. Thus, the driver 45 and the rotatable member 41*b* define the untwisting mechanism 60 which untwists the net by rotatively driving the weight member 40.

On the other hand, the twist detecting device 50 which detects the twist of the net is disposed above the weight member 40 (on the net proximal side). The twist detecting device 50 essentially includes an area sensor 51 which detects the width of the net between the roller 37 and the weight member 40. If the net width detected by the area sensor 51 is smaller than a reference value, it is judged that the net is twisted. The judgment is made by a controller not shown. A signal from the area sensor 51 is inputted to the controller and, if an input value is smaller than the reference value, the controller outputs a control signal to the driver 45 to rotatively drive the driver 45 by a predetermined amount. Thereafter, the controller judges again on the basis of a signal from the area sensor 51 whether the net width is smaller than the reference value. If the net width is smaller, the controller rotatively drives the driver 45 in a reverse direction to untwist the net.

The driving of the actuators described above may be properly controlled by an electronic control unit, a hydraulic pressure circuit and the like.

As shown in FIGS. 21 to 27, the rolling apparatus according to this embodiment may include a product unloading device 70. The unloading device 70 is disposed above the support member 6 (on the net proximal side). In the embodiment shown in the figures, the unloading device 70 is preferably disposed between the support member 6 and the weight holder 41, and attached and fixed to the frame 5. The unloading device 70 may also serve as a net cutting mechanism which cuts a portion of the net present on the proximal side with respect to the formed annular roll portion C, and a net fusion-bonding mechanism which melts and solidifies the axially intermediate portion of the net on the proximal side with respect to the formed annular roll portion C. The unloading device 70 includes a base 71 attached and fixed to the frame 5, a turntable 73 rotatably provided on the base 71 via a rotation shaft 72, a chuck 74 retractable radially of the net with respect to the turntable 73, and a net cutting device 75 retractable radially of the net with respect to the turntable 73.

A driver such as a motor (not shown) which rotatively drives the rotation shaft 72 is mounted in the base 71. An actuator 76 which retractably drives the chuck 74 radially of the net, and an actuator 77 which retractably drives the net cutting device 75 radially of the net are mounted on the turntable 73 in stacked relation. The chuck 74 includes a pair of right and left holder arms. An actuator 78 which drives the pair of arms for opening and closing the arms is provided at a proximal portion of the chuck 74. At least inner surfaces of the arms are made of a metal which can be heated by high frequency heating.

The cutting device 75 includes an electrical heating wire attached to a board 79, and is retractably driven via the board 79 by an actuator 77. An electrically conductive wire 80 such as of copper is provided on the board 79 as surrounding the chuck 74, and the cutting device 75 is connected to one end of the electrically conductive wire 80. Power supply wires are respectively connected to the other end of the electrically conductive wire 80 and the other end of the electrically conductive wire 80, and a high frequency voltage is applied to the electrically conductive wire 80 and the cutting device 75 via the power supply wires to heat the cutting device 75. Further, the electrically conductive wire 80 also serves as a high frequency coil for heating the arms through high frequency heating by applying the high frequency voltage to the electrically conductive wire 80. When the net is held by the heated arms, the net is melted by the arms, and a net material of a net portion held by the arms is fusion-bonded. Thereafter, the arms are cooled or separated from the net, whereby the fusion-bonded portion is solidified. Alternatively, heating electrodes may be provided on the inner surfaces of the arms, so that the inner surfaces of the arms can be heated by directly applying a voltage to the heating electrodes.

Figure 21:
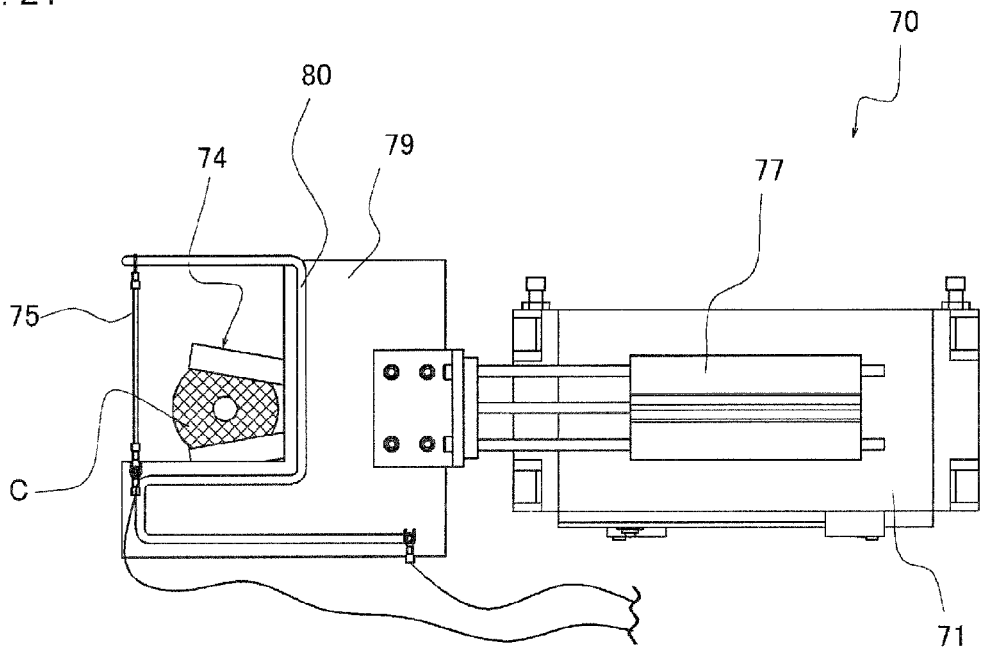
FIG. 21 is a plan view of a net unloading device.
Figure 22:
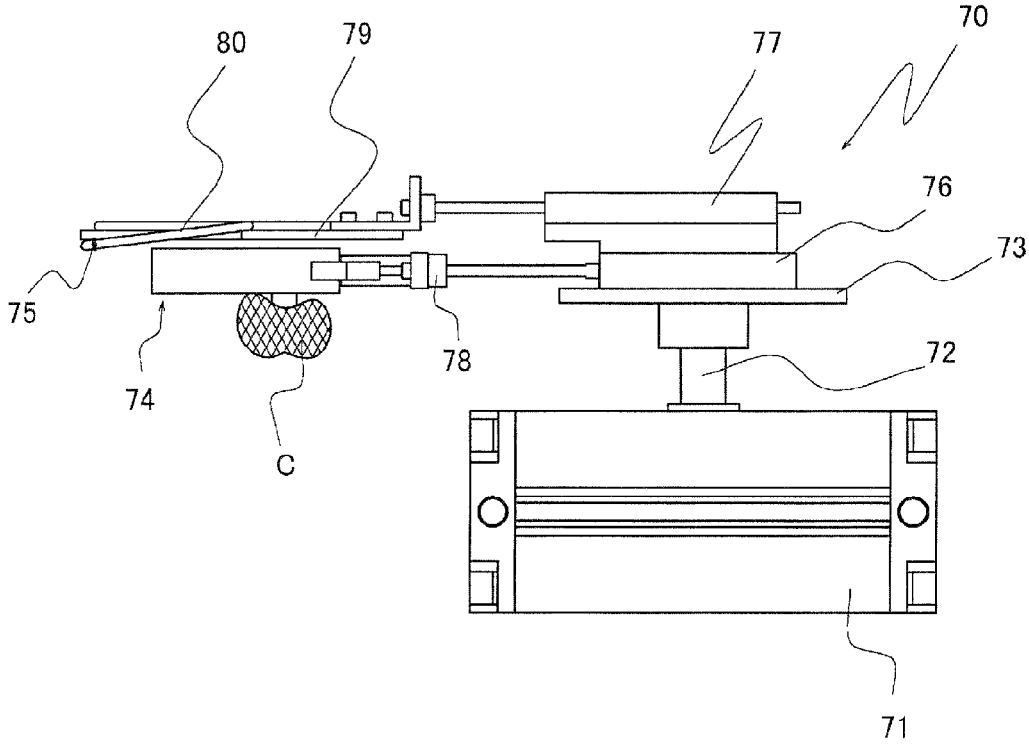
FIG. 22 is a front view of the net unloading device.
Figure 23:
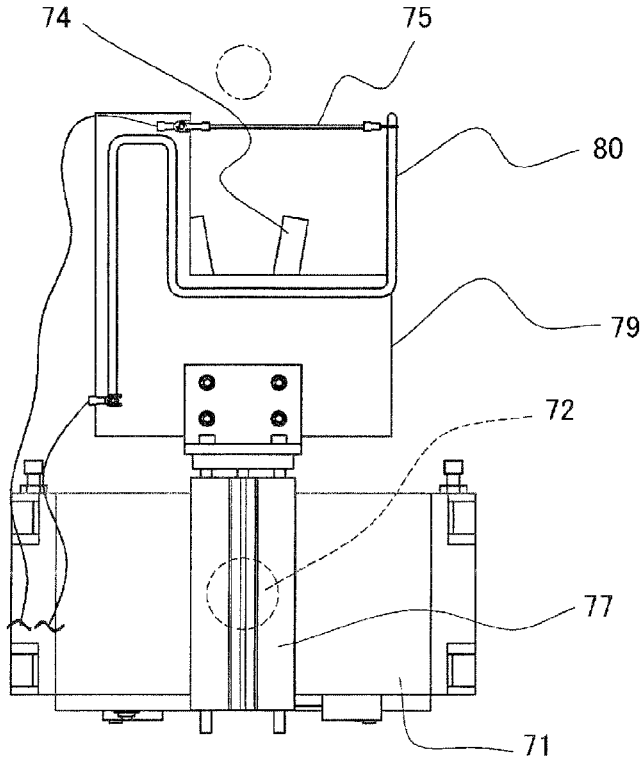
FIG. 23 is an explanatory diagram for explaining the operation of the net unloading device.
Figure 24:
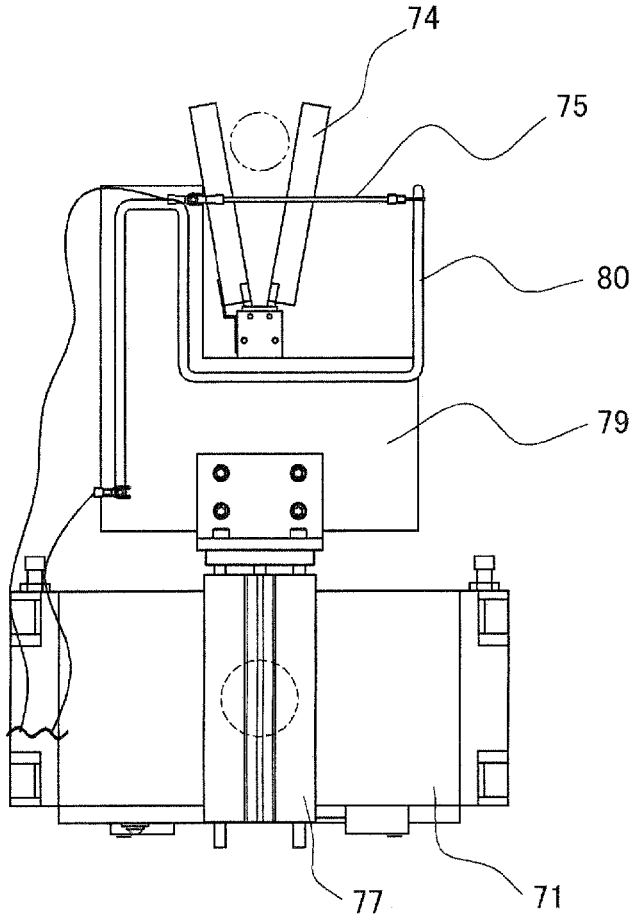
FIG. 24 is an explanatory diagram for explaining the operation of the net unloading device.
Figure 25:
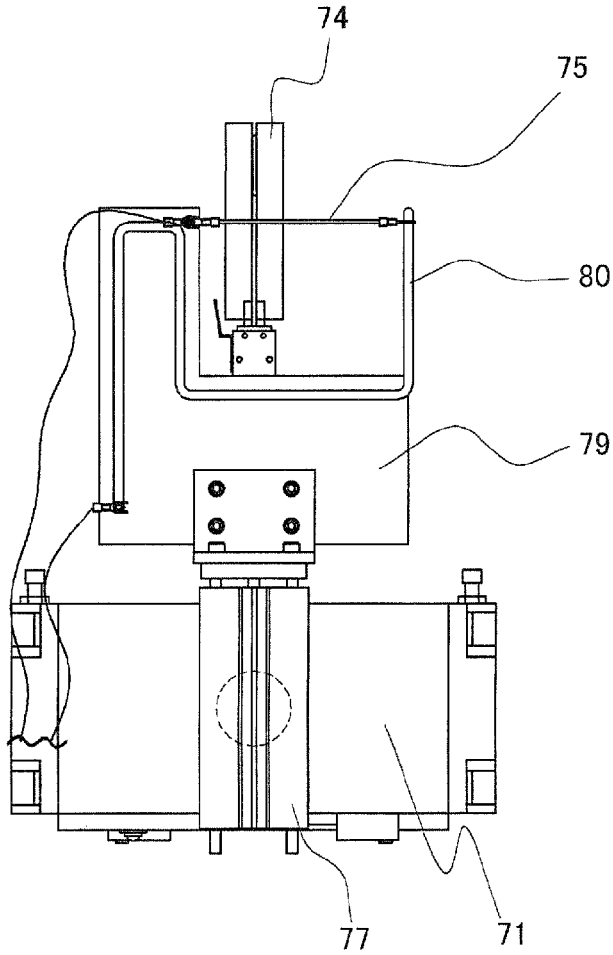
FIG. 25 is an explanatory diagram for explaining the operation of the net unloading device.
Figure 26:
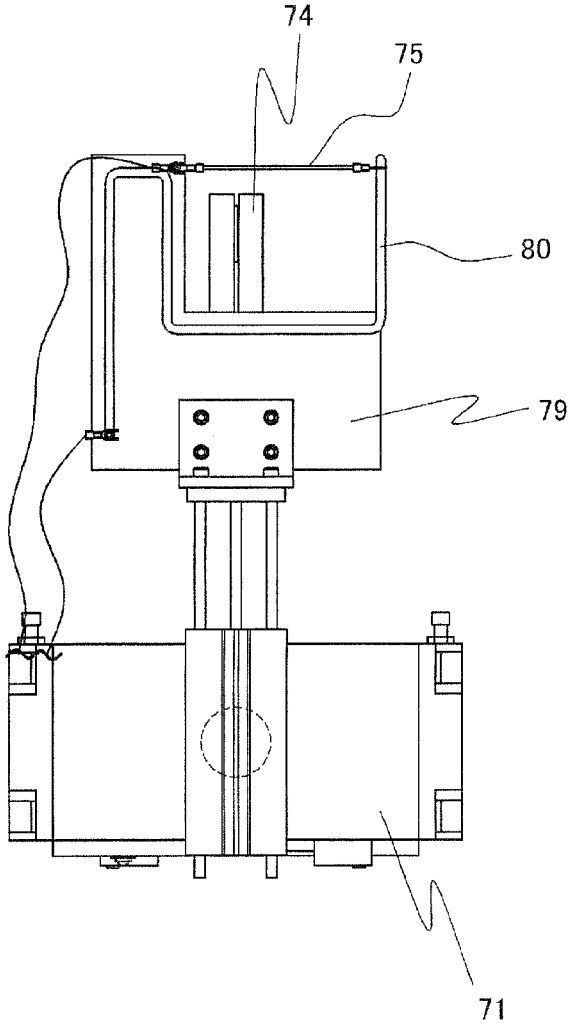
FIG. 26 is an explanatory diagram for explaining the operation of the net unloading device.
Figure 27:
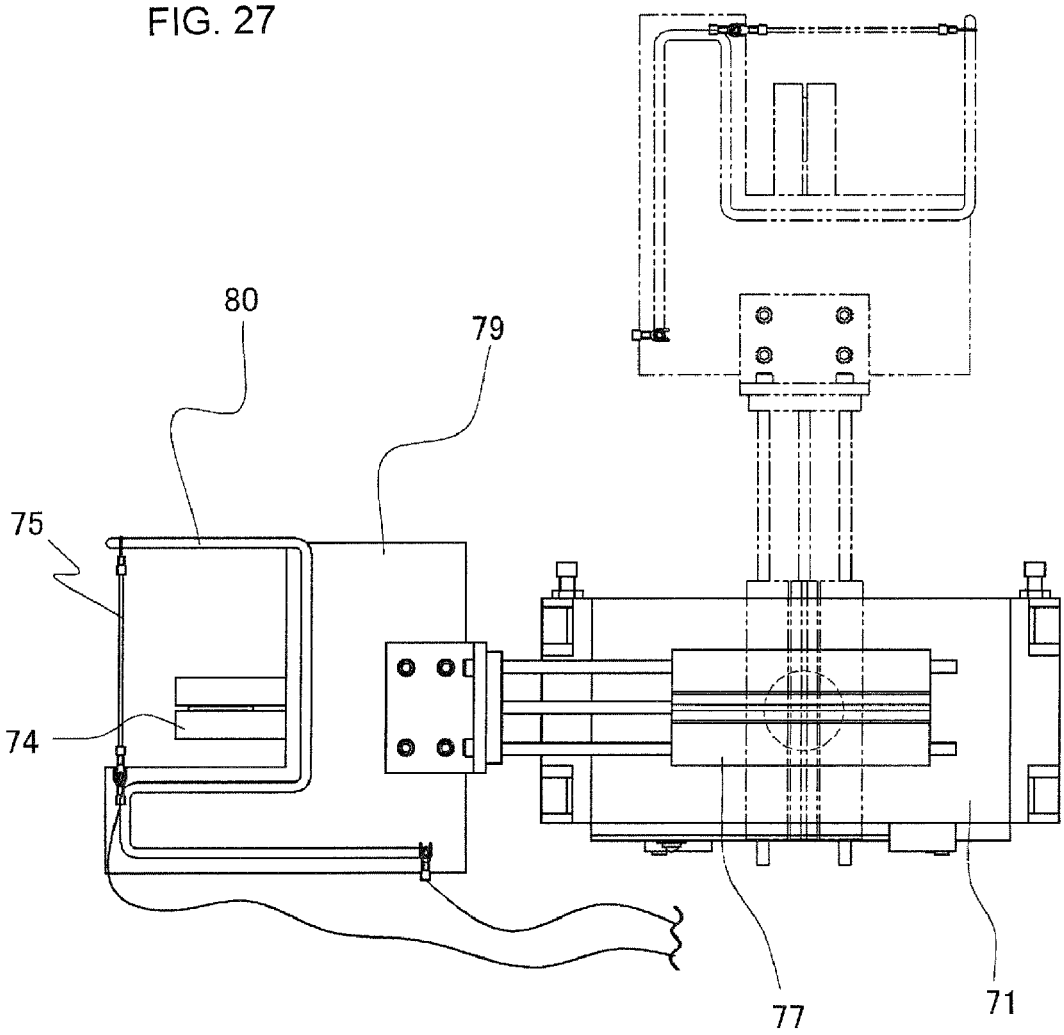
FIG. 27 is an explanatory diagram for explaining the operation of the net unloading device.

The operation of the aforementioned unloading device 70 will be described. With the formed annular roll portion C being held by the distal portion of the support member 6, the net portion projecting upward from the annular roll portion C is opposed to the chuck 74 as shown in FIG. 23. At this time, the chuck 74 and the cutting device 75 are retracted away from the net, and the chuck 74 is heated through high frequency heating while being opened. Then, the chuck 74 is moved toward the net by driving the actuator 76 as shown in FIG. 24, and closed by the actuator 78 to hold the net portion projecting upward from the annular roll portion as shown in FIG. 25. The net portion thus held has a planar shape. At this time, the held net portion is fusion-bonded into a unitary plate by the heat of the arms. In turn, the cutting device 75 is moved forward by driving the actuator 77 as shown in FIG. 26 to cut a portion of the net above the net portion held by the chuck 74. Subsequently, the turntable 73 is turned with the annular roll portion being held by the chuck 74 as shown in FIG. 27 to move the annular roll portion C to an unloading position. Then, the chuck 74 is opened as shown in FIGS. 21 and 22 to allow the annular roll portion C to naturally fall.

Figure 28:
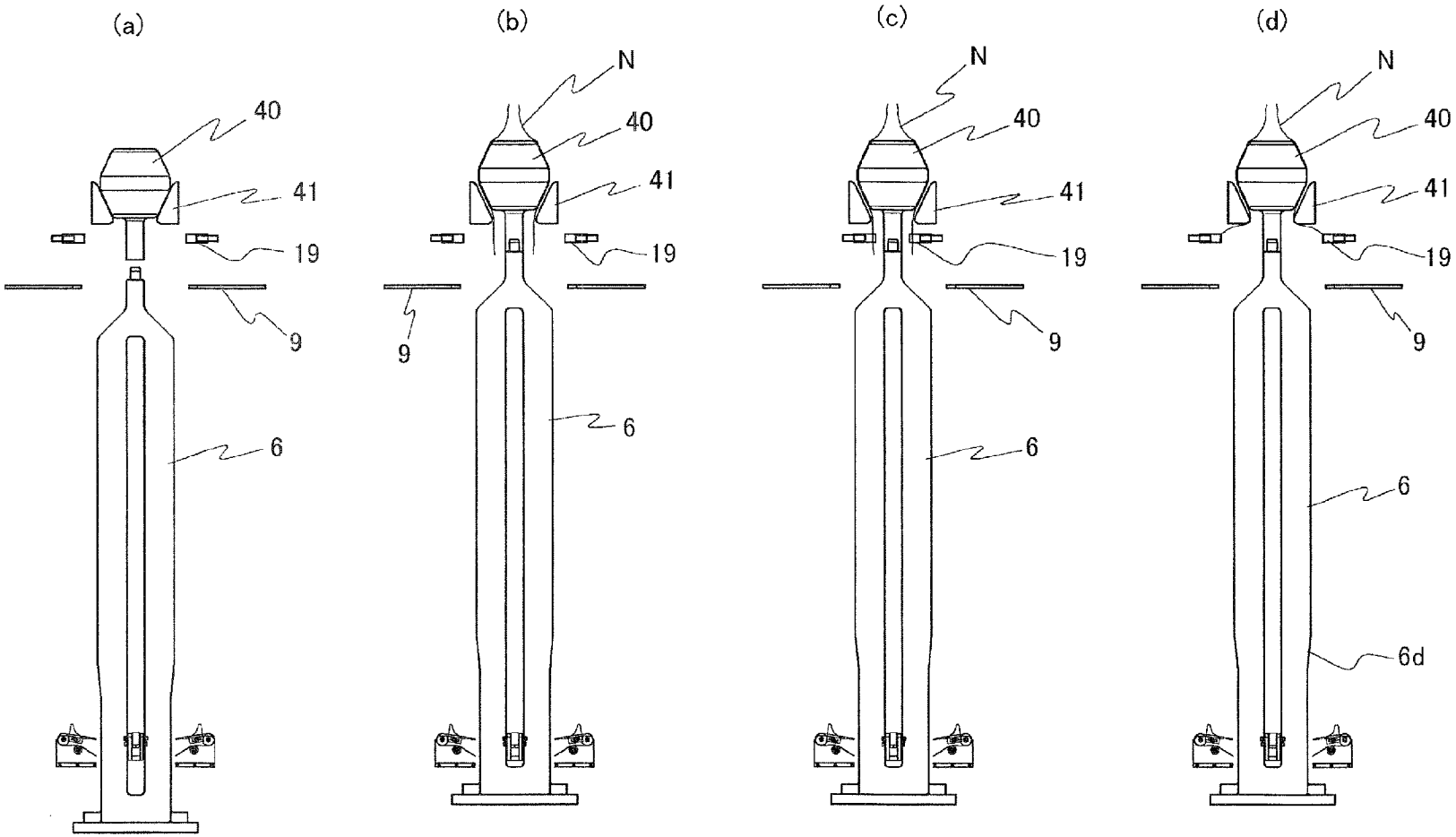
FIG. 28 is a diagram showing a process for producing a container packing filler by using the apparatus.
Figure 29:
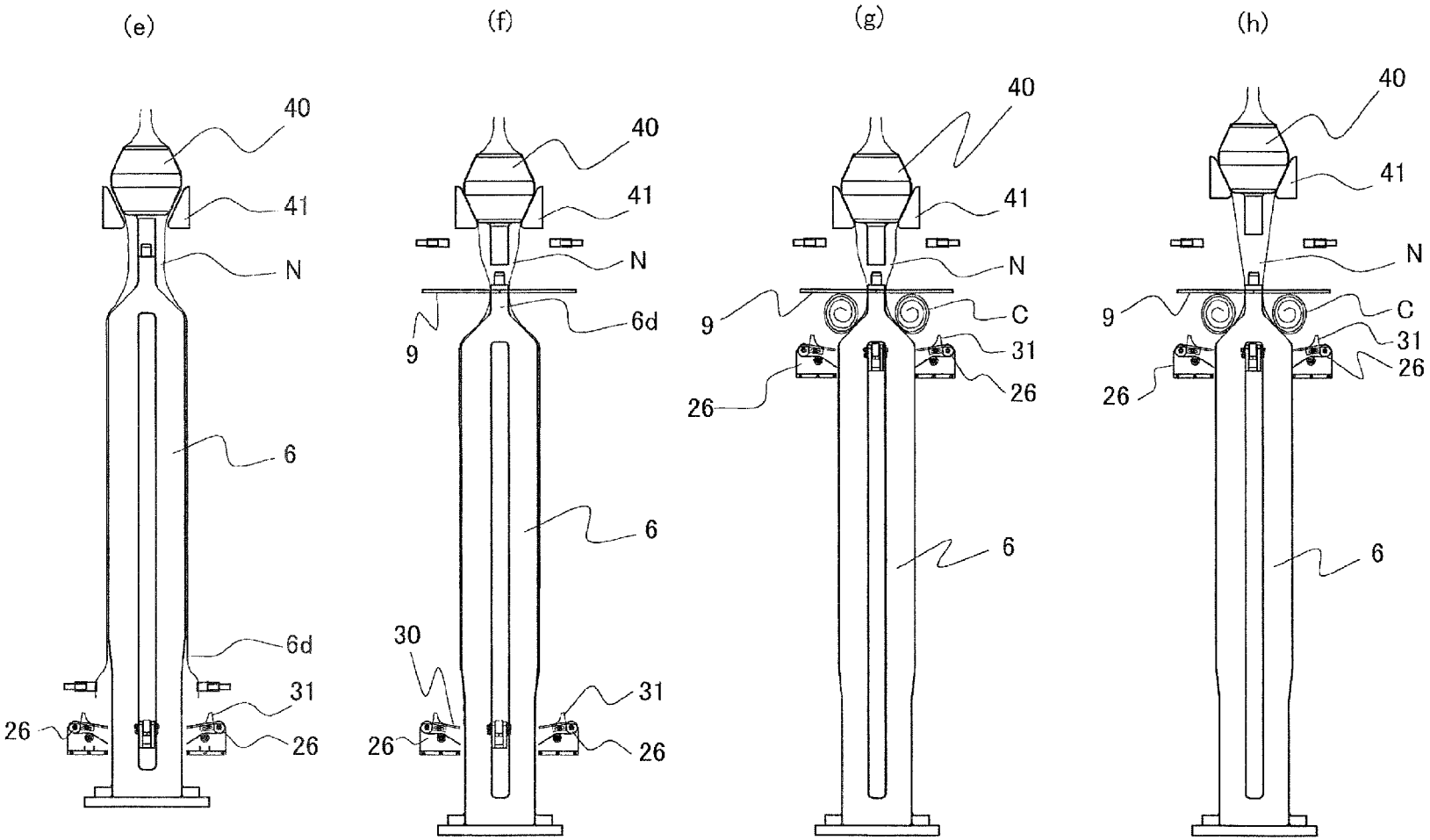
FIG. 29 is a diagram showing the process for producing the container packing filler by using the apparatus.

FIGS. 28 and 29 schematically illustrate Steps (a) to (h) of a process for producing a container packing filler having an annular roll portion C from a continuously supplied stretchable tubular net N with the use of the apparatus according to this embodiment.

In Step (a), the apparatus is in an initial state as shown in FIG. 1. At the beginning of the production process, the weight member 40 is manually inserted into the net N. In Step (b), the weight member 40 is set in the weight holder 41. At this time, a distal portion of the net hanging down from the weight holder 41 is located slightly below the catches 19. When the operation of the apparatus is started in this state, the distal portion of the net N is held by the catches 19 in Step (c), and the diameter of the distal portion is significantly increased in Step (d). Then, the distal portion of the net N is drawn downward by the catches 19 with the diameter of an opening thereof increased, whereby the net N is fitted around the support member 6 in Step (e). During the fitting of the net N, the weight member 40 is lifted by the support member 6 to be spaced away from the weight holder 41.

After the fitting of the net N, the catches 19 and the holders 9 are moved back to upper limit positions, and then the paired holders 9 are closed in Step (f), whereby an axially intermediate portion of the net N is held between the holders 9 and the distal smaller diameter shaft portion 6*b* of the support member 6 to prevent the net N from slipping off from the support member 6. In this state, the rolling mechanism 8 is actuated to be moved axially upward with the belts 30 being circularly rotated. Thus, the distal portion of the net N is rolled up while being forcibly folded radially outward, whereby the net N is rolled up radially outward to form an annular roll portion C in Step (g). The annular roll portion C is guided by the upper tapered surface of the support member 6 and, therefore, is liable to leap up. However, the annular roll portion C is held on the upper tapered surface of the support member 6 by the holders 9.

Then, the weight holder 41 is moved upward together with the weight member 40, whereby a portion of the net N projecting from the annular roll portion C to the proximal side is drawn toward the proximal side relative to the annular roll portion C with the annular roll portion C being supported by the holders 9 kept in abutment against a proximal side portion of the annular roll portion C. Thus, the annular roll portion C is tightened in Step (h). This makes it possible to provide a packing filler of an even size. Even if the annular roll portion is released from the holders 9, the roll portion is unlikely to slack because the annular roll portion is tightened. Thus, the products have more even quality.

Figure 30:
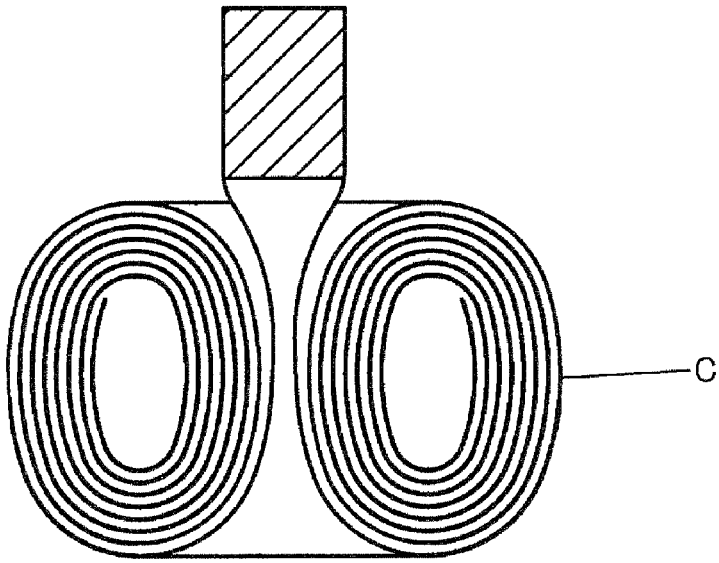
FIG. 30 is a schematic sectional view of the container packing filler produced by using the apparatus.

Thereafter, the portion of the net N projecting from the annular roll portion C to the proximal side is cut at a predetermined axial position, and a proximal net portion adjacent to the annular roll portion C is bound to be closed manually or by means of a separate cutting/fusion-bonding device. The binding step may be performed in the apparatus, or may be performed in another apparatus after the resulting annular roll portion C is unloaded. Thus, a container packing filler as shown in FIG. 30 is produced. It is noted that the net N is preferably untwisted by the untwisting mechanism 60 before the net N is fitted around the support member 6 after the cutting of the net N.

The present invention is not limited to the aforementioned embodiments, but modifications may be made to the embodiments as appropriate. For example, the circular rotation member is not limited to the roller belt, but other appropriate rotation mechanism such as a cord-shaped member, a wheel or a ball may be employed as the circular rotation member.

What is claimed is:

1. A container packing filler production method comprising:

a first step of fitting a stretchable tubular net around a columnar support member; and a second step of forcibly folding a distal portion of the net radially outward or inward by a plurality of circular rotation members disposed circumferentially of the net while moving the circular rotation members toward a net proximal side axially relative to the support member, whereby the net is rolled up radially outward or inward with the distal portion thereof being folded by circular rotation and axial movement of the circular rotation members to form an annular roll portion; wherein the second step comprises driving the circular rotation members by a motor independently of the axial movement of the circular rotation members.

2. The container packing filler production method as set forth in claim 1 wherein the step of driving the circular rotation members comprises driving an endless belt around spaced rollers.

3. A container packing filler production method comprising:

a first step of fitting a stretchable tubular net around a columnar support member;

a second step of forcibly folding a distal portion of the net radially outward or inward by a plurality of circular rotation members disposed circumferentially of the net while selectively controlling a variable speed of rotation of the circular rotation members; and a third step of moving the circular rotation members towards a net proximal side axially relative to the support member while controlling an axial movement speed independently of the speed of rotation of the circular rotation members so that the net is rolled up radially outward or inward with the distal portion thereof being folded by circular rotation and axial movement of the circular rotation members to form an annular roll portion and thereby to allow selection of one of at least: a) different rolling densities; b) different diameters; and c) different heights of the annular roll portion.

4. A container packing filler production method as set forth in claim 3, further comprising a fourth step of tightening the annular roll portion by drawing a portion of the net projecting from the annular roll portion to the proximal side relative to the annular roll portion toward the proximal side while supporting the annular roll portion by keeping a holder in abutment against a proximal side portion of the annular roll portion after the annular roll portion is formed by rolling the tubular net radially outward or inward from an axially distal end toward an axially proximal end of the net.

5. A container packing filler production method as set forth in claim 4, further comprising a fifth step of binding a proximal end portion of the net formed by cutting the net portion projecting from the annular roll portion to the proximal side at a predetermined axial position to close the proximal end portion after the fourth step.

6. A container packing filler production method as set forth in claim 3, wherein an axially intermediate portion of the net present adjacent an end of the support member on the net proximal side is held by the end of the support member on the net proximal side in the second step.

7. A container packing filler production method as set forth in claim 3, further comprising a fourth step of, after forming an annular roll portion by rolling a tubular net radially outward or inward from an axially distal end toward an axially proximal end of the net, tightening the annular roll portion by drawing a portion of the net projecting from the annular roll portion to a proximal side relative to the annular roll portion toward the proximal side while supporting the annular roll portion by keeping a holder in abutment against a proximal side portion of the annular roll portion.

8. The container packing filler production method as set forth in claim 3 wherein the second step comprises driving the circular rotation members by a motor.

9. The container packing filler production method as set forth in claim 8 wherein the step of driving the circular rotation members comprises driving an endless belt around spaced rollers.

* * * * *